US011468825B2

(12) United States Patent
Xuan et al.

(10) Patent No.: US 11,468,825 B2
(45) Date of Patent: Oct. 11, 2022

(54) PIXEL CIRCUIT, DRIVING METHOD THEREOF AND DISPLAY DEVICE

(71) Applicant: BOE Technology Group Co., Ltd., Beijing (CN)

(72) Inventors: Minghua Xuan, Beijing (CN); Qi Qi, Beijing (CN); Jing Liu, Beijing (CN); Han Yue, Beijing (CN); Dongni Liu, Beijing (CN)

(73) Assignee: BEIJING BOE TECHNOLOGY DEVELOPMENT CO., LTD., Beijing (CN)

( * ) Notice: Subject to any disclaimer, the term of this patent is extended or adjusted under 35 U.S.C. 154(b) by 0 days.

(21) Appl. No.: 17/265,325

(22) PCT Filed: Mar. 17, 2020

(86) PCT No.: PCT/CN2020/079664

§ 371 (c)(1),
(2) Date: Feb. 2, 2021

(87) PCT Pub. No.: WO2021/184192

PCT Pub. Date: Sep. 23, 2021

(65) Prior Publication Data

US 2022/0114949 A1 Apr. 14, 2022

(51) Int. Cl.
*G09G 3/32* (2016.01)

(52) U.S. Cl.
CPC ..... *G09G 3/32* (2013.01); *G09G 2310/061* (2013.01); *G09G 2310/066* (2013.01); *G09G 2320/045* (2013.01)

(58) Field of Classification Search
CPC .... G09G 3/325; G09G 3/3291; G09G 3/3659; G09G 3/3283; G09G 2320/045; G09G 2310/0251; G09G 2300/0814; G09G 2300/0819; G09G 2300/0842; G09G 2300/0866; G09G 3/3241; G09G 3/3258
See application file for complete search history.

(56) References Cited

U.S. PATENT DOCUMENTS 6,917,350 B2 * 7/2005 Pae ..... G09G 3/3233 345/55
7,071,906 B2 * 7/2006 Nishitani ..... G09G 3/3258 315/169.3

(Continued)

*Primary Examiner* — Michael J Jansen, II
(74) *Attorney, Agent, or Firm* — Nath, Goldberg & Meyer; Joshua B. Goldberg

(57) ABSTRACT

The present disclosure provides a pixel circuit including: a current control circuit and a time control circuit, the time control circuit includes: a first resetting sub-circuit configured to write a reference voltage and a first initialization voltage to a first node and a second node, respectively; a first data writing sub-circuit configured to write a first data voltage to the first node; a first threshold compensation sub-circuit configured to perform threshold compensation on a transistor within a switch sub-circuit; a ramp writing sub-circuit configured to write a preset ramp signal to the first node; and the switch sub-circuit configured to control electrical coupling and decoupling between a third node and a fourth node. The present disclosure further provides a driving method of the pixel circuit and a display device.

21 Claims, 11 Drawing Sheets

(56) References Cited

U.S. PATENT DOCUMENTS

| | | | | |
|---|---|---|---|---|
| 7,358,935 | B2 * | 4/2008 | Yamashita | G09G 3/2022 345/82 |
| 7,692,613 | B2 * | 4/2010 | Choi | G09G 3/3233 345/82 |
| 9,214,107 | B2 * | 12/2015 | Fish | G09G 3/3233 |
| 10,504,444 | B2 * | 12/2019 | Cheng | G09G 3/32 |
| 10,657,889 | B2 * | 5/2020 | Li | G09G 3/3233 |
| 11,127,348 | B2 * | 9/2021 | Li | G09G 3/3233 |
| 2002/0089357 | A1 * | 7/2002 | Pae | G09G 3/3233 327/112 |
| 2003/0142048 | A1 * | 7/2003 | Nishitani | G09G 3/3258 345/82 |
| 2005/0156828 | A1 * | 7/2005 | Yamashita | G09G 3/3258 345/76 |
| 2005/0212787 | A1 * | 9/2005 | Noguchi | G09G 3/3291 345/204 |
| 2006/0022305 | A1 * | 2/2006 | Yamashita | G09G 3/2014 257/565 |
| 2006/0139253 | A1 * | 6/2006 | Choi | G09G 3/3233 345/76 |
| 2006/0256048 | A1 * | 11/2006 | Fish | G09G 3/3233 345/81 |
| 2019/0057651 | A1 * | 2/2019 | Li | G09G 3/3233 |
| 2019/0279570 | A1 * | 9/2019 | Cheng | G09G 3/3258 |
| 2020/0243009 | A1 * | 7/2020 | Li | G09G 3/3233 |

* cited by examiner

PIXEL CIRCUIT, DRIVING METHOD THEREOF AND DISPLAY DEVICE

This is a National Phase Application filed under 35 U.S.C. 371 as a national stage of PCT/CN2020/079664, filed Mar. 17, 2020, the content of which is hereby incorporated by reference in its entirety.

TECHNICAL FIELD

The present disclosure relates to the field of display technology, and in particular, to a pixel circuit, a driving method thereof, and a display device.

BACKGROUND

Micro Light Emitting Diode (Micro-LED) technology is a technology in which an array of Micro-sized LEDs is integrated on one chip with high density to realize thin-filming, microminiaturization and matrixing of the LEDs, an interval between pixels can reach micron level, and each pixel can be addressed and emit light independently. Micro-LED display panels have been gradually developed toward display panels to be used in consumer terminals due to their characteristics of low driving voltage, long service life, wide temperature resistance, and the like.

SUMMARY

Embodiments of the present disclosure provide a pixel circuit, a driving method thereof and a display device, which can improve a display effect of a display device.

In a first aspect, an embodiment of the present disclosure provides a pixel circuit, including: a current control circuit and a time control circuit, the current control circuit is configured to generate a driving current and output the driving current to the time control circuit, wherein the time control circuit includes: a first resetting sub-circuit, a first data writing sub-circuit, a first threshold compensation sub-circuit, a ramp writing sub-circuit and a switch sub-circuit, the first resetting sub-circuit, the first data writing sub-circuit and the ramp writing sub-circuit and the switch sub-circuit are coupled to a first node, the first resetting sub-circuit, the first threshold compensation sub-circuit and the switch sub-circuit are coupled to a second node, the first threshold compensation sub-circuit, the switch sub-circuit and the current control circuit are coupled to a third node, and the first threshold compensation sub-circuit, the switch sub-circuit and an element to be driven are coupled to a fourth node;

the first resetting sub-circuit is configured to write a reference voltage and a first initialization voltage to the first node and the second node, respectively, in response to control of a signal of a first reset signal line;

the first data writing sub-circuit is configured to write a first data voltage to the first node in response to control of a signal of a first gate line;

the first threshold compensation sub-circuit is configured to write the reference voltage to the third node and perform threshold compensation on a transistor within the switch sub-circuit in response to control of the signal of the first gate line;

the ramp writing sub-circuit is configured to write a preset ramp signal to the first node in response to control of a signal of a control signal line;

the switch sub-circuit is configured to adjust a voltage at the second node according to a voltage difference between a voltage of the ramp signal loaded at the first node and the first data voltage, and to control electrical coupling and decoupling between the third node and the fourth node in response to control of the voltage at the second node.

In some implementations, the first resetting sub-circuit includes: a first transistor and a second transistor, a control electrode of the first transistor is coupled to the first reset signal line, a first electrode of the first transistor is coupled to a reference voltage terminal, and a second electrode of the first transistor is coupled to the first node;

a control electrode of the second transistor is coupled to the first reset signal line, a first electrode of the second transistor is coupled to a first initialization voltage terminal, and a second electrode of the second transistor is coupled to the second node.

In some implementations, the first data writing sub-circuit includes: a third transistor, a control electrode of the third transistor is coupled to the first gate line, a first electrode of the third transistor is coupled to a first data line, and a second electrode of the third transistor is coupled to the first node.

In some implementations, the first threshold compensation sub-circuit includes: a fourth transistor and a fifth transistor, a control electrode of the fourth transistor is coupled to the first gate line, a first electrode of the fourth transistor is coupled to a reference voltage terminal, and a second electrode of the fourth transistor is coupled to the third node;

a control electrode of the fifth transistor is coupled to the first gate line, a first electrode of the fifth transistor is coupled to the second node, and a second electrode of the fifth transistor is coupled to the fourth node.

In some implementations, the ramp writing sub-circuit includes; a sixth transistor, a control electrode of the sixth transistor is coupled to the control signal line, a first electrode of the sixth transistor is coupled to a ramp signal line, and a second electrode of the sixth transistor is coupled to the first node.

In some implementations, the switch sub-circuit includes: a seventh transistor and a first capacitor, a control electrode of the seventh transistor is coupled to the second node, a first electrode of the seventh transistor is coupled to the third node, and a second electrode of the seventh transistor is coupled to the fourth node;

a first terminal of the first capacitor is coupled to the first node, and a second terminal of the first capacitor is coupled to the second node.

In some implementations, the pixel circuit further includes: a first output control sub-circuit configured to couple the element to be driven to the fourth node;

the first output control sub-circuit is configured to control electrical coupling and decoupling between the fourth node and the element to be driven in response to control of a signal of the control signal line.

In some implementations, the first output control sub-circuit includes: an eighth transistor, a control electrode of the eighth transistor is coupled to the control signal line, a first electrode of the eighth transistor is coupled to the fourth node, and a second electrode of the eighth transistor is coupled to the element to be driven.

In some implementations, a signal line which supplies the first data voltage to the first data writing sub-circuit and a signal line which supplies the ramp signal to the ramp writing sub-circuit are shared.

In some implementations, the current control circuit includes: a second resetting sub-circuit, a second data writing sub-circuit, a second threshold compensation sub-circuit, a second output control sub-circuit, a driving transistor and a second capacitor, the second resetting sub-circuit, a control electrode of the driving transistor and the second threshold compensation sub-circuit are coupled to a fifth node, a first electrode of the driving transistor, the second data write sub-circuit and the second output control sub-circuit are coupled to a sixth node, and a second electrode of the driving transistor, the second threshold compensation sub-circuit and the second output control sub-circuit are coupled to a seventh node;

the second resetting sub-circuit is configured to write a second initialization voltage to the fifth node in response to control of a signal of a second reset signal line;

the second data writing sub-circuit is configured to write a second data voltage to the sixth node in response to control of a signal of a second gate line;

the second threshold compensation sub-circuit is configured to perform threshold compensation on the driving transistor in response to control of the signal of the second gate line;

the second output control sub-circuit is coupled to the third node, and is configured to write a first operation voltage into the sixth node, and control the third node and the seventh node to be electrically coupled, in response to control of the signal of the control signal line, the driving transistor is configured to output a corresponding driving current in response to control of a voltage at the fifth node;

a first terminal of the second capacitor is coupled to a first operation voltage terminal, and a second terminal of the second capacitor is coupled to the fifth node.

In some implementations, the second resetting sub-circuit includes a ninth transistor, the second data writing sub-circuit includes a tenth transistor, the second threshold compensation sub-circuit includes an eleventh transistor, the second output control sub-circuit includes a twelfth transistor and a thirteenth transistor;

a control electrode of the ninth transistor is coupled to the second reset signal line, a first electrode of the ninth transistor is coupled to a second initialization voltage terminal, and a second electrode of the ninth transistor is coupled to the fifth node;

a control electrode of the tenth transistor is coupled to the second gate line, a first electrode of the tenth transistor is coupled to a second data line, and a second electrode of the tenth transistor is coupled to the sixth node;

a control electrode of the eleventh transistor is coupled to the second gate line, a first electrode of the eleventh transistor is coupled to the fifth node, and a second electrode of the eleventh transistor is coupled to the seventh node;

a control electrode of the twelfth transistor is coupled to the control signal line, a first electrode of the twelfth transistor is coupled to the first operation voltage terminal, and a second electrode of the twelfth transistor is coupled to the sixth node;

a control electrode of the thirteenth transistor is coupled to the control signal line, a first electrode of the thirteenth transistor is coupled to the seventh node, and a second electrode of the thirteenth transistor is coupled to the third node.

In some implementations, the current control circuit further includes a third capacitor, a first terminal of the third capacitor is coupled to the second gate line, and a second terminal of the third capacitor is coupled to the fifth node.

In some implementations, the current control circuit includes: a second resetting sub-circuit, a second data writing sub-circuit, a second threshold compensation sub-circuit, a second output control sub-circuit, a driving transistor, a fourth capacitor, and a fifth capacitor, wherein a control electrode of the driving transistor, the second threshold compensation sub-circuit, and the second resetting sub-circuit are coupled to an eighth node, the second resetting sub-circuit and the second data writing sub-circuit are coupled to a ninth node, and a second electrode of the driving transistor, the second threshold compensation sub-circuit, and the second output control sub-circuit are coupled to a tenth node;

the second resetting sub-circuit is configured to write a second initialization voltage and a preset constant voltage to the eighth node and the ninth node, respectively, in response to control of a signal of the second reset signal line, and write the preset constant voltage to the ninth node in response to control of the signal of the control signal line;

the second data writing sub-circuit is configured to write a second data voltage to the ninth node in response to control of a signal of the second gate line;

the second threshold compensation sub-circuit is configured to perform threshold compensation on the driving transistor in response to control of the signal of the second gate line;

the second output control sub-circuit is coupled to the third node and is configured to control the third node and the tenth node to be electrically coupled, in response to control of the signal of the control signal line;

the driving transistor is configured to output a corresponding driving current in response to control of a voltage at the eighth node;

a first terminal of the fourth capacitor is coupled to a first operation voltage terminal, and a second terminal of the fourth capacitor is coupled to the eighth node;

a first terminal of the fifth capacitor is coupled to the ninth node, and a second terminal of the fifth capacitor is coupled to the eighth node.

In some implementations, the second resetting sub-circuit includes a fourteenth transistor, a fifteenth transistor, and a sixteenth transistor, the second data writing sub-circuit includes a seventeenth transistor, the second threshold compensation sub-circuit includes an eighteenth transistor, the second output control sub-circuit includes a nineteenth transistor;

a control electrode of the fourteenth transistor is coupled to the second reset signal line, a first electrode of the fourteenth transistor is coupled to a second initialization voltage terminal, and a second electrode of the fourteenth transistor is coupled to the eighth node;

a control electrode of the fifteenth transistor is coupled to the second reset signal line, a first electrode of the fifteenth transistor is coupled to a constant voltage terminal, and a second electrode of the fifteenth transistor is coupled to the ninth node;

a control electrode of the sixteenth transistor is coupled to the control signal line, a first electrode of the sixteenth transistor is coupled to the constant voltage terminal, and a second electrode of the sixteenth transistor is coupled to the ninth node;

a control electrode of the seventeenth transistor is coupled to the second gate line, a first electrode of the seventeenth transistor is coupled to the second data line, and a second electrode of the seventeenth transistor is coupled to the ninth node;

a control electrode of the eighteenth transistor is coupled to the second gate line, a first electrode of the eighteenth transistor is coupled to the eighth node, and a second electrode of the eighteenth transistor is coupled to the tenth node;

a control electrode of the nineteenth transistor is coupled to the control signal line, a first electrode of the nineteenth transistor is coupled to the tenth node, and a second electrode of the nineteenth transistor is coupled to the third node.

In some implementations, all transistors in the pixel circuit are N-type transistors;

or all the transistors in the pixel circuit are P-type transistors.

In a second aspect, an embodiment of the present disclosure provides a display device, including: a display substrate including a plurality of sub-pixels, at least one of the sub-pixels is provided therein with the pixel circuit provided in the first aspect and an element to be driven, the pixel circuit being configured to provide a driving signal to the element to be driven.

In some implementations, the element to be driven includes: an LED or a Micro-LED.

In a third aspect, an embodiment of the present disclosure provides a driving method for driving the pixel circuit provided in the first aspect, the driving method including:

applying a first reset signal to the first reset signal line, a reference voltage to a reference voltage terminal, and a first initialization voltage to a first initialization voltage terminal, so that the first resetting sub-circuit writes the reference voltage and the first initialization voltage to the first node and the second node, respectively, in response to control of the reset signal;

applying a first gate scan signal to the first gate line, a first data voltage to a first data line, so that the first data writing sub-circuit writes the first data voltage to the first node in response to control of the first gate scan signal, the first threshold compensation sub-circuit performs threshold compensation on a transistor in the switch sub-circuit in response to control of the first gate scan signal; and applying a control signal to the control signal line, a ramp signal to a ramp signal line, so that the ramp writing sub-circuit writes the ramp signal to the first node in response to control of the control signal, and the switch sub-circuit adjusts a voltage at the second node according to a voltage difference between a voltage of the ramp signal applied at the first node and the first data voltage, and controls electrical coupling and decoupling between the third node and the fourth node in response to control of the voltage at the second node.

In some implementations, the current control circuit includes: a second resetting sub-circuit, a second data writing sub-circuit, a second threshold compensation sub-circuit, a second output control sub-circuit, a driving transistor and a second capacitor;

the driving method further includes:

before applying the control signal to the control signal line and applying the ramp signal to the ramp signal line, applying a second reset signal to the second reset signal line, a second initialization voltage to a second initialization voltage terminal, so that the second resetting sub-circuit applies the second initialization voltage to a fifth node in response to control of the second reset signal;

applying a second gate scan signal to a second gate line, and a second data voltage to a second data line, so that the second data writing sub-circuit writes the second data voltage to a sixth node in response to control of the second gate scan signal, and the second threshold compensation sub-circuit performs threshold compensation on the driving transistor in response to control of the second gate scan signal; and when the control signal is applied to the control signal line, the second output control sub-circuit writes a first operation voltage into the sixth node and control the third node and the seventh node to be electrically coupled, in response to the control signal, and the driving transistor outputs a corresponding driving current in response to control of a voltage at the fifth node.

In some implementations, the current control circuit includes: a second resetting sub-circuit, a second data writing sub-circuit, a second threshold compensation sub-circuit, a second output control sub-circuit, a driving transistor, a fourth capacitor and a fifth capacitor;

the driving method further includes:

before applying the control signal to the control signal line and the ramp signal to the ramp signal line, applying a second reset signal to a second reset signal line, a second initialization voltage to a second initialization voltage terminal, and a constant voltage to a constant voltage terminal, so that the second resetting sub-circuit applies the second initialization voltage and the constant voltage to an eighth node and a ninth node, respectively, in response to control of the second reset signal;

applying a second gate scan signal to a second gate line, and a second data voltage to a second data line, so that the second data writing sub-circuit writes the second data voltage to the ninth node in response to control of the second gate scan signal, and the second threshold compensation sub-circuit performs threshold compensation on the driving transistor in response to control of the second gate scan signal;

when the control signal is applied to the control signal line, the second resetting sub-circuit writes the constant voltage to the ninth node in response to control of the control signal, the second output control sub-circuit controls the third node and the tenth node to be electrically coupled, in response to control of the control signal, and the driving transistor outputs a corresponding driving current in response to control of a voltage at the eighth node.

DESCRIPTION OF EMBODIMENTS

In order to make those ordinary skilled in the art better understand technical solutions of the present invention, a pixel circuit, a driving method thereof, and a display device provided by the present disclosure are described in detail below with reference to the accompanying drawings.

In embodiments of the present disclosure, the element to be driven may be a light emitting element, and the light emitting element may be a light emitting device driven by current/voltage, including a light emitting diode (LED) or a Micro-LED, and in the following embodiments, the element to be driven is the Micro-LED, and a size of the Micro-LED is in the micrometer (μm) level.

In addition, each of transistors involved in the embodiments of the present disclosure may be independently selected from a polycrystalline silicon thin film transistor, an amorphous silicon thin film transistor, an oxide thin film transistor, or an organic thin film transistor. A "control electrode" involved in the present disclosure specifically refers to a gate electrode of a transistor, a "first electrode" specifically refers to a source electrode of the transistor, and a corresponding "second electrode" specifically refers to a drain electrode of the transistor. Certainly, those ordinary skilled in the art will understand that the "first electrode" and the "second electrode" are interchangeable.

In addition, the transistors may be divided into N-type transistors and P-type transistors, and each of the transistors in the present disclosure may be independently selected from an N-type transistor or a P-type transistor; in the following embodiments, all transistors in a pixel unit are N-type transistors, which may be fabricated simultaneously by a same fabrication process. Correspondingly, a first operation voltage is a high-level operation voltage Vdd, and a second operation voltage is a low-level operation voltage Vss.

Figure 1:
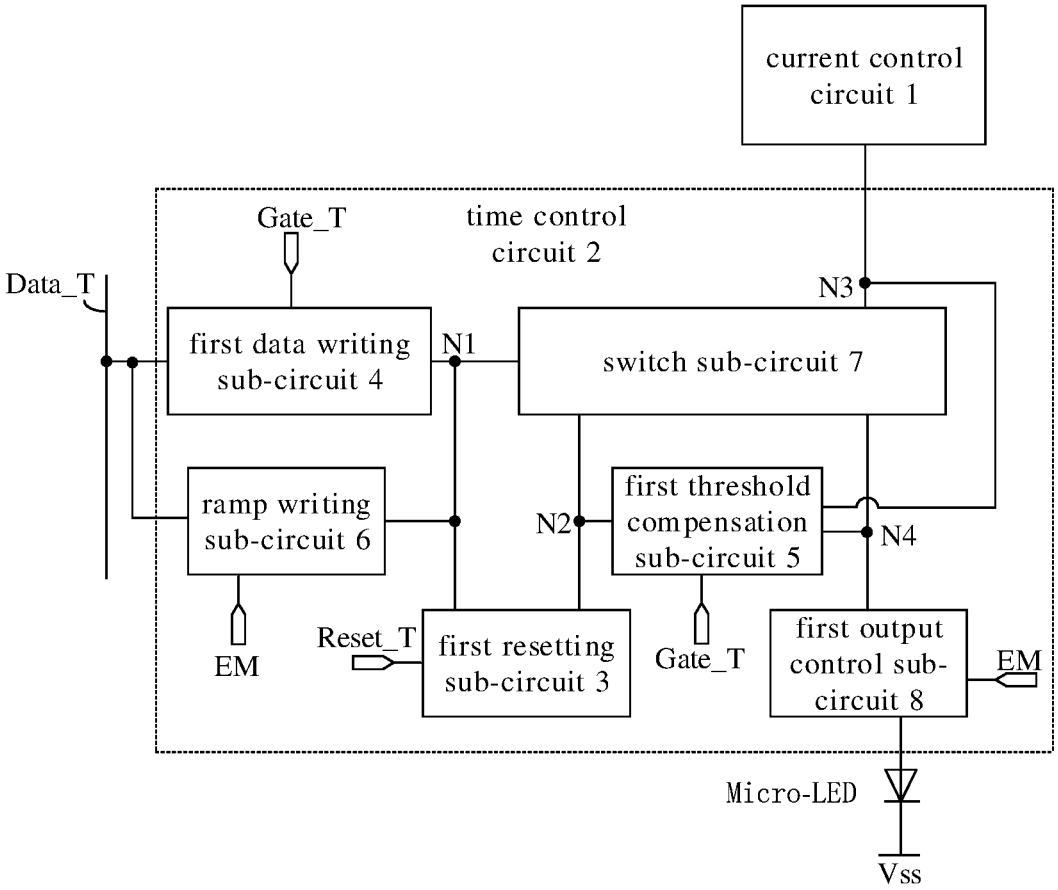
FIG. 1 is a schematic circuit diagram of a pixel circuit according to an embodiment of the present disclosure.

FIG. 1 is a schematic circuit diagram of a pixel circuit according to an embodiment of the present disclosure, and as shown in FIG. 1, the pixel circuit includes: a current control circuit 1 and a time control circuit 2, the current control circuit 1 is configured to generate a driving current and output the driving current to the time control circuit 2. The time control circuit 2 includes: a first resetting sub-circuit 3, a first data writing sub-circuit 4, a first threshold compensation sub-circuit 5, a ramp writing sub-circuit 6 and a switch sub-circuit 7, where the first resetting sub-circuit 3, the first data writing sub-circuit 4, the ramp writing sub-circuit 6 and the switch sub-circuit 7 are coupled to a first node N1, the first resetting sub-circuit 3, the first threshold compensation sub-circuit 5, and the switch sub-circuit 7 are coupled to a second node N2, the first threshold compensation sub-circuit 5, the switch sub-circuit 7 and the current control circuit 1 are coupled to a third node N3, the first threshold compensation sub-circuit 5, the switch sub-circuit 7 and an anode of the element (Micro-LED) to be driven are coupled to a fourth node N4, and a cathode of the element (Micro-LED) to be driven is coupled to a second operation voltage terminal.

The first resetting sub-circuit 3 is configured to write a reference voltage and a first initialization voltage to the first node N1 and the second node N2, respectively, in response to control of a signal of a first reset signal line Reset_T.

The first data writing sub-circuit 4 is configured to write a first data voltage to the first node N1 in response to control of a signal of a first gate line Gate_T.

The first threshold compensation sub-circuit 5 is configured to write the reference voltage to the third node N3 in response to control of the signal of the first gate line Gate_T and perform threshold compensation on a transistor within the switch sub-circuit 7.

The ramp writing sub-circuit 6 is configured to write a preset ramp signal to the first node N1 in response to control of a signal of a control signal line EM.

The switch sub-circuit 7 is configured to adjust a voltage at the second node N2 according to a voltage difference between a voltage of the ramp signal loaded at the first node N1 and the first data voltage, and control electrical coupling and decoupling between the third node N3 and the fourth node N4 in response to control of the voltage at the second node N2.

In some implementations, when a transistor in the switch sub-circuit 7 is a P-type transistor, the ramp signal is a voltage signal that increases in voltage magnitude with a fixed rate of change over time. When the transistor in the switch sub-circuit 7 is an N-type transistor, the ramp signal is a voltage signal that decreases in the voltage magnitude at a fixed rate of change over time.

In the embodiment of the present disclosure, the switch sub-circuit 7 is switchable between an "on" state and an "off" state in response to control of the voltage at the second node N2. Specifically, when the switch sub-circuit 7 is in the "on" state, the third node N3 is electrically coupled to the fourth node N4, and the current control circuit 1 can output a driving current to the element (Micro-LED) to be driven; when the switch sub-circuit 7 is in the "off" state, the third node N3 and the fourth node N4 are electrically decoupled from each other, and the current control circuit 1 does not output the driving current. The voltage at the second node N2 is determined by the voltage difference between the voltage of the ramp signal loaded at the first node N1 and the first data voltage. Under the condition that an initial voltage and a change rate of voltage of the ramp signal are constant, a time duration in which the voltage at the second node N2 changes from that at the beginning of a display stage to a critical voltage that enables the switch sub-circuit 7 to switch from the "off" state to the "on" state, that is, the time duration that the switch sub-circuit 7 is in the "off" state in the display stage, can be controlled by adjusting the magnitude of the first data voltage. In a period (for example, in a frame), under a condition that a total time duration of the display stage is fixed, the time duration of the switch sub-circuit 7 in the "on" state can be controlled by controlling the time duration of the switch sub-circuit 7 in the "off" state. Therefore, an operation time duration of the element (Micro-LED) to be driven (the time duration of the switch sub-circuit 7 in the "on" state) in a period can be controlled by controlling the magnitude of the first data voltage.

Since the magnitude of the current flowing through the element (Micro-LED) to be driven and the operation time duration of the element (Micro-LED) to be driven in a period (for example, in a frame) affect the effective light emitting brightness of the element (Micro-LED) to be driven in the period, the effective light emitting brightness of the element (Micro-LED) to be driven in the period can be controlled by the driving current provided by the current control circuit 1 and the first data voltage provided by the first data line Data_T, so as to achieve a purpose of adjusting a display gray scale.

Figure 2:
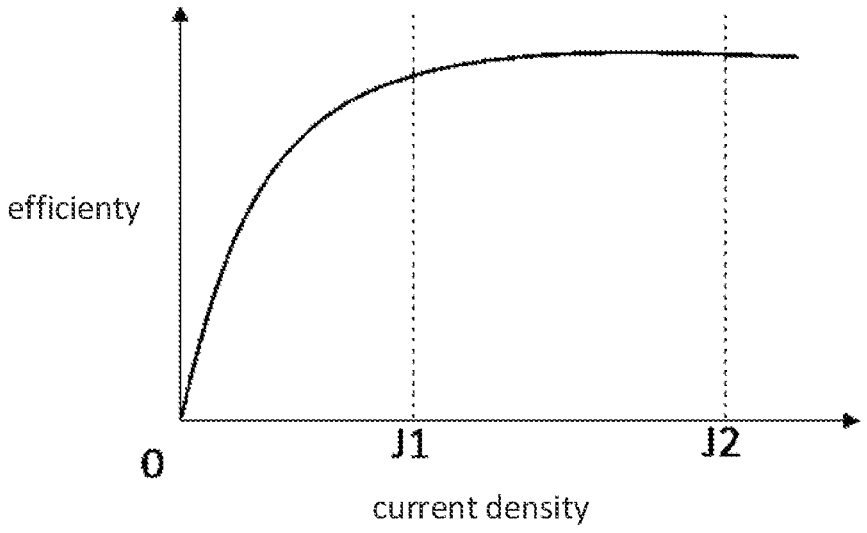
FIG. 2 is a schematic diagram of device characteristics of an element to be driven in an embodiment of the present disclosure.

FIG. 2 is a schematic diagram illustrating device characteristics of an element (Micro-LED) to be driven in an embodiment of the present disclosure, and as shown in FIG. 2, a light emitting efficiency of the element (Micro-LED) to be driven gradually increases with increasing of a current density and stabilizes at a maximum value when the current density is between J1 and J2. Thus, in consideration of saving display power consumption, the element (Micro-LED) to be driven is generally required to operate in a state where the current density is between J1 and J2. However, the current density being between J1 and J2 is very limited for many types of elements Micro-LED to be driven, and if different gray scales are obtained by adjusting only the magnitude of current, the resulting display contrast may be very low. For this reason, in the embodiment of the present disclosure, the current density of the element (Micro-LED) to be driven in operation is set within a stable range (between J1 and J2) by the current control circuit 1, and the time duration of the switch sub-circuit 7 in the "on" state in each period is adjusted by the time control circuit 2 to control the display gray scale, so as to achieve high contrast of a display device.

According to the technical solution of the present disclosure, the high contrast is realized on the premise that the current density of the element (Micro-LED) to be driven is in the stable range, the problems of color cast, efficiency reduction and the like caused by the fact that the current density of the element (Micro-LED) to be driven is out of the stable range can be avoided, and the high contrast required by a display product can be realized. Therefore, the embodiment of the present disclosure can reduce the display defects caused by the electrical characteristics of the micro-LED being easy to drift with the current density, and improve the display performance of related display products.

Figure 3:
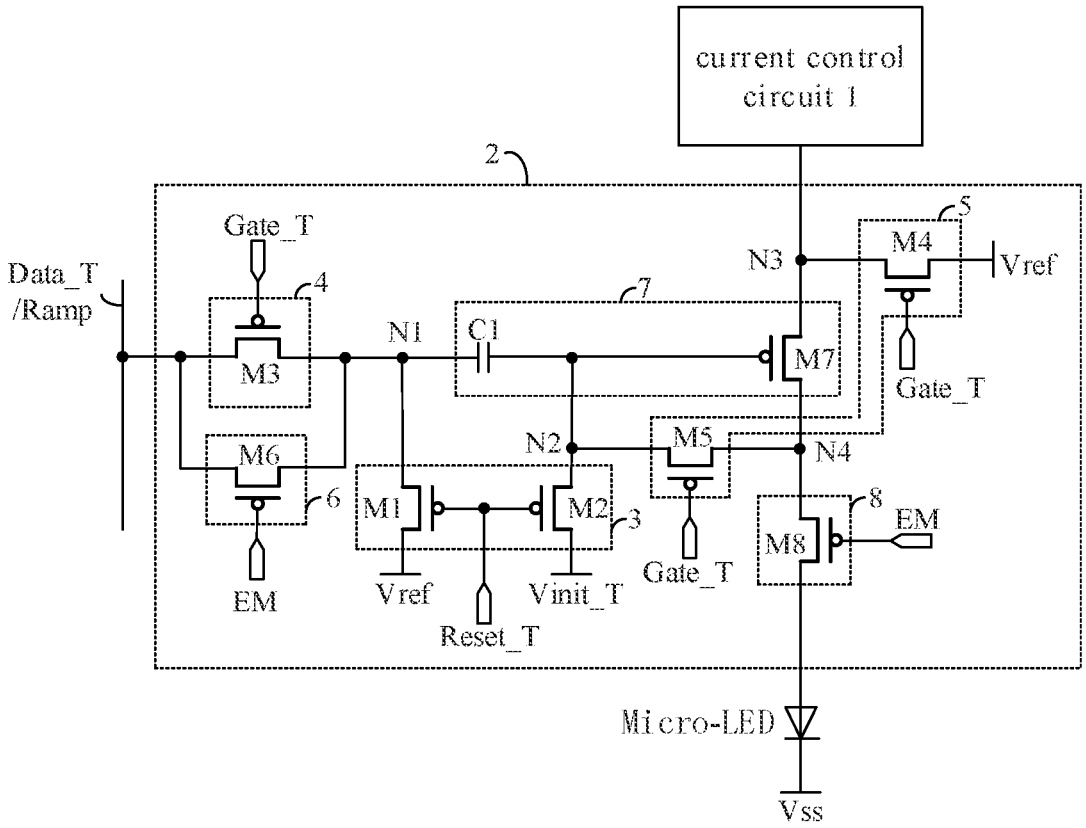
FIG. 3 is a schematic circuit diagram of a pixel circuit according to another embodiment of the present disclosure.

FIG. 3 is a schematic circuit diagram of a pixel circuit provided in another embodiment of the present disclosure, and as shown in FIG. 3, the pixel circuit is a specific realization of the pixel circuit shown in FIG. 1. The reference voltage terminal provides the reference voltage Vref, the first initialization voltage terminal provides the first initialization voltage Vinit_T, and the first data line Data_T provides the first data voltage Vdata_T for the pixel circuit.

In some implementations, the first resetting sub-circuit 3 includes: a first transistor M1 and a second transistor M2, a control electrode of the first transistor M1 is coupled to the first reset signal line Reset_T, a first electrode of the first transistor M1 is coupled to the reference voltage terminal, and a second electrode of the first transistor M1 is coupled to the first node N1; a control electrode of the second transistor M2 is coupled to the first reset signal line Reset_T, a first electrode of the second transistor M2 is coupled to the first initialization voltage terminal, and a second electrode of the second transistor M2 is coupled to the second node N2.

In some implementations, the first data writing sub-circuit 4 includes: a third transistor M3; a control electrode of the third transistor M3 is coupled to a first gate line Gate_T, a first electrode of the third transistor M3 is coupled to the first data line Data_T, and a second electrode of the third transistor M3 is coupled to the first node N1.

In some implementations, the first threshold compensation sub-circuit 5 includes: a fourth transistor M4 and a fifth transistor M5; a control electrode of the fourth transistor M4 is coupled to the first gate line Gate_T, a first electrode of the fourth transistor M4 is coupled to the reference voltage terminal, and a second electrode of the fourth transistor M4 is coupled to the third node N3; a control electrode of the fifth transistor M5 is coupled to the first gate line Gate_T, a first electrode of the fifth transistor M5 is coupled to the second node N2, and a second electrode of the fifth transistor M5 is coupled to the fourth node N4.

In some implementations, the ramp writing sub-circuit 6 includes: a sixth transistor M6; a control electrode of the sixth transistor M6 is coupled to the control signal line EM, a first electrode of the sixth transistor M6 is coupled to a ramp signal line Ramp, and a second electrode of the sixth transistor M6 is coupled to the first node N1.

In some implementations, the switch sub-circuit 7 includes: a seventh transistor M7 and a first capacitor C1; a control electrode of the seventh transistor M7 is coupled to the second node N2, a first electrode of the seventh transistor M7 is coupled to the third node N3, and a second electrode of the seventh transistor M7 is coupled to the fourth node N4; a first terminal of the first capacitor C1 is coupled to the first node N1, and a second terminal of the first capacitor C1 is coupled to the second node N2.

In some implementations, the pixel circuit further includes: a first output control sub-circuit 8, through which the element (Micro-LED) to be driven is coupled to the fourth node N4; the first output control sub-circuit 8 is configured to control electrical coupling and decoupling between the fourth node N4 and the element (Micro-LED) to be driven in response to control of a signal of the control signal line EM. Furthermore, the first output control sub-circuit 8 includes: an eighth transistor M8; a control electrode of the eighth transistor M8 is coupled to the control signal line EM, a first electrode of the eighth transistor M8 is coupled to the fourth node N4, and a second electrode of the eighth transistor M8 is coupled to the element (Micro-LED) to be driven.

It should be noted that, in the present embodiment, the first output control sub-circuit 8 is configured to prevent a current (for example, when the first threshold compensation sub-circuit 5 performs the threshold compensation processing on the seventh transistor M7 in the switch sub-circuit 7, a current is output from the seventh transistor M7 during a short time) from flowing to the element (Micro-LED) to be driven during a non-display stage so that the element (Micro-LED) to be driven emits light by mistake and the display effect is affected. It will be appreciated by those ordinary skilled in the art that the first output control sub-circuit 8 is optional for the present disclosure, and is not a necessary structure in the pixel circuit.

In order to reduce the number of signal lines in the display panel, the signal line (i.e., the first data line Data_T) for supplying the first data voltage to the first data writing sub-circuit 4 and the signal line (i.e., the ramp signal line Ramp) for supplying the ramp signal to the ramp writing sub-circuit 6 are shared and the same signal line in the embodiment of the present disclosure. The signal line can provide the first data voltage for pixel circuits corresponding thereto in a first writing and compensation stage, and provide the ramp signal for the pixel circuits in a display stage.

Figure 4:
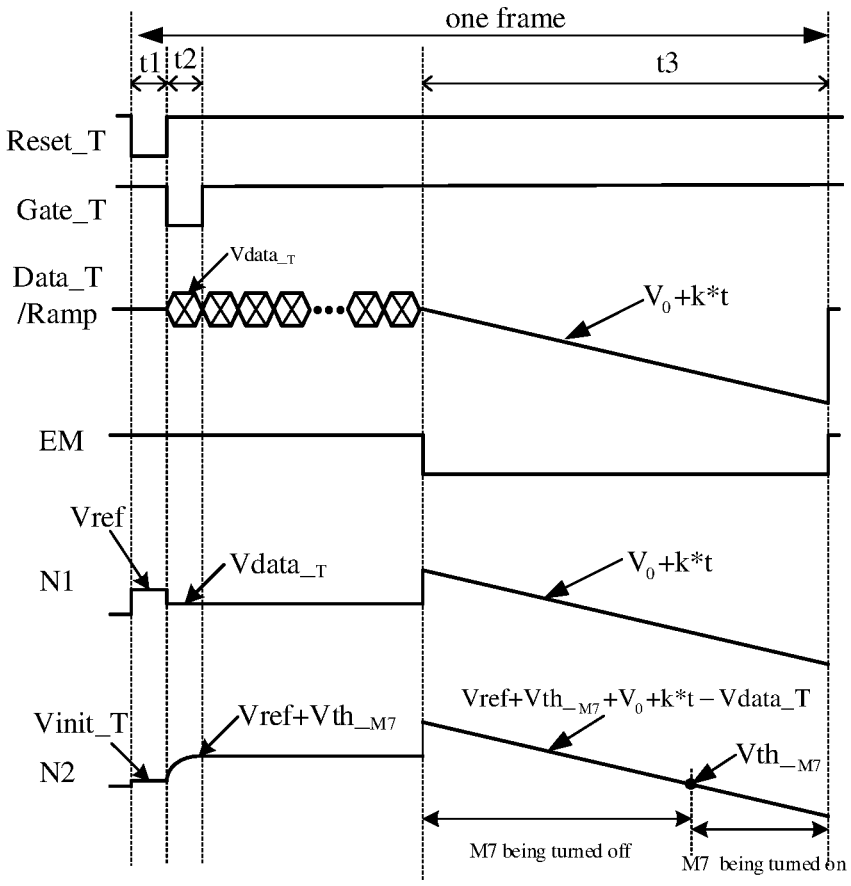
FIG. 4 is a timing diagram illustrating an operation of the pixel circuit shown in FIG. 3.

An operation of the pixel circuit shown in FIG. 3 will be described in detail below with reference to the accompanying drawing. FIG. 4 is a timing diagram illustrating an operation of the pixel circuit shown in FIG. 3, and as shown in FIG. 4, the operation of the pixel circuit includes the following stages including a first reset stage t1, a first writing and compensation stage t2 and a display stage t3.

In the first reset stage t1, the first reset signal provided by the first reset signal line Reset_T is at a low level, a first gate scan signal provided by the first gate line Gate_T is at a high level, and the control signal provided by the control signal line EM is at a high level. In such case, the first transistor M1 and the second transistor M2 are turned on, and the third transistor M3 to the eighth transistor M8 are turned off. The reference voltage Vref provided by the reference voltage terminal is written to the first node N1 through the first transistor M1, and the first initialization voltage Vinit_T provided by the first initialization voltage terminal is written to the second node N2 through the second transistor M2. Since the seventh transistor M7 is turned off, the third node N3 and the fourth node N4 are electrically decoupled from each other.

In the first writing and compensation stage t2, the first reset signal provided by the first reset signal line Reset_T is at a high level, the first gate scan signal provided by the first gate line Gate_T is at a low level, and the control signal provided by the control signal line EM is at a high level. In such case, the third to fifth transistors M3 to M5 are turned on, and the first transistor M1, the second transistor M2, the sixth transistor M6, and the eighth transistor M8 are turned off. The seventh transistor M7 is turned on first and then turned off.

Since the third transistor M3 is turned on, the first data voltage Vdata_T can be written to the first node N1 through the third transistor M3. Since the fourth transistor M4 is turned on, the reference voltage Vref is written to the third node N3 through the fourth transistor M4; since the fifth transistor M5 is turned on, the seventh transistor M7 forms a diode structure at this time, the third node N3 can charge the second node N2 through the seventh transistor M7, the fourth node N4 and the fifth transistor M5, and when the voltage at the second node N2 is charged to $Vref+Vth_{_M7}$, the seventh transistor M7 is turned off, so that the threshold compensation of the seventh transistor M7 is completed, where $Vth_{_M7}$ is the threshold voltage of the seventh transistor M7 (if the seventh transistor M7 is a P-type transistor, $Vth_{_M7}$ is a negative value). At the end of the first writing and compensation stage t2, the voltage at the first node N1 is Vdata_T, the voltage at the second node N2 is $Vref+Vth_{_M7}$, and a voltage difference between two terminals of the first capacitor C1 is $Vdata_T-Vref-Vth_{_M7}$.

In the display stage 3, the first reset signal provided by the first reset signal line Reset_T is at a high level, the first gate scan signal provided by the first gate line Gate_T is at a high level, and the control signal provided by the control signal line EM is at a low level. The sixth transistor M6 and the eighth transistor M8 are turned on, and the first to fifth transistors M1 to M5 are turned off. The seventh transistor M7 is turned off first and then turned off.

In the display stage t3, the voltage of the ramp signal is $V_0+k*t$, $V_0$ is an initial voltage of the ramp signal at the beginning of the display stage t3 in a period, and k is a change rate of voltage (if the seventh transistor M7 is a P-type transistor, k is a negative value, and if the seventh transistor M7 is an N-type transistor, k is a positive value).

At the beginning of the display stage t3, the voltage at the first node N1 changes from Vdata_T to $V_0$, and under the bootstrap action of the first capacitor C1, the voltage at the second node N2 changes from $Vref+Vth_{_M7}$ to $Vref+Vth_{_M7}+V_0-Vdata_T$. Thereafter, the voltage at the first node N1 changes with the change of voltage of the loaded ramp signal, and after time t within the display stage t3, the voltage at the first node N1 is $V_0+k*t$, the voltage at the second node N2 is $Vref+Vth_{_M7}+V_0+k*t-Vdata_T$, and under a condition that Vref and $Vth_{_M7}$ are constant, the voltage at the second node N2 is only related to a voltage difference between the voltage $V_0+k*t$ at the first node N1 and the first data voltage Vdata_T, that is, the voltage at the second node N2 is determined according to the voltage difference between the voltage $V_0+k*t$ at the first node N1 and the first data voltage Vdata_T.

When the voltage $Vref+Vth_{_M7}+V_0+k*t-Vdata_T$ at the second node N2 decreases to $Vth_{_M7}$, the seventh transistor M7 is switched from being turned off to being turned on, that is, $Vref+Vth_{_M7}+V_0+k*t-Vdata_T=Vth_{_M7}$, and $$t = \frac{Vdata_T - V_0 - Vref}{k}$$

can be obtained. It can be seen that, when $V_0$, k and Vref are constant, the time duration in which the seventh transistor M7 is turned off (the time duration in which the switch sub-circuit 7 is in the "off" state) in the display stage t3 is only related to the first data voltage Vdata_T. The time durations in which the switch sub-circuit 7 is respectively in the "off" state and in the "on" state in the display stage t3 can thus be controlled by the first data voltage Vdata_T.

In addition, since the time duration t of the switch sub-circuit 7 in the "off" state in the display stage t3 is unrelated to the threshold voltage $Vth_{_M7}$ of the seventh transistor M7, the problem of inaccurate control for the time duration of "off"/"on" due to drifting of threshold voltage can be effectively avoided, and the accuracy of gray scale control can be improved.

After the seventh transistor M7 is switched to be turned on, the driving current provided by the current control circuit 1 can flow into the element (Micro-LED) to be driven, and the element (Micro-LED) to be driven operates.

It should be noted that there is an interval between the first writing and compensation stage t2 and the display stage t3, and the interval is used for the pixel circuits of other rows in the display panel performing the first data voltage writing and the threshold value compensation.

Figure 5:
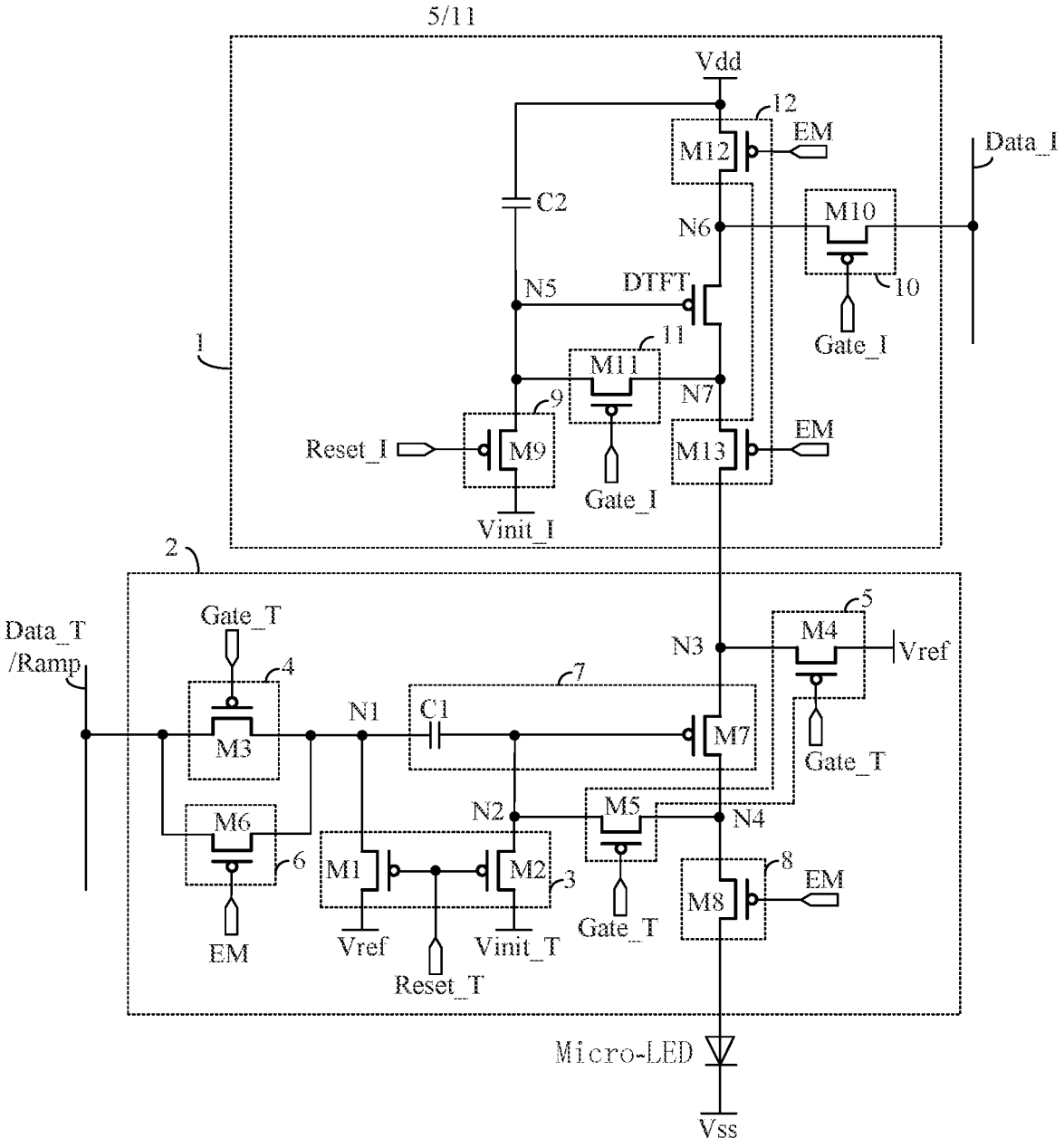
FIG. 5 is a schematic circuit diagram of a pixel circuit according to further another embodiment of the present disclosure.

FIG. 5 is a schematic circuit diagram of a pixel circuit provided by another embodiment of the present disclosure, and as shown in FIG. 5, the pixel circuit is a specific realization of the pixel circuits shown in FIG. 1 and FIG. 3, where a second initialization voltage terminal provides a second initialization voltage Vinit_I.

In some implementations, the current control circuit 1 includes: a second resetting sub-circuit 9, a second data writing sub-circuit 10, a second threshold compensation sub-circuit 11, a second output control sub-circuit 12, a driving transistor DTFT, and a second capacitor C2, where the second resetting sub-circuit 9, a control electrode of the driving transistor DTFT, and the second threshold compensation sub-circuit 11 are coupled to a fifth node N5, a first electrode of the driving transistor DTFT, the second data writing sub-circuit 10, and the second output control sub-circuit 12 are coupled to a sixth node N6, and a second electrode of the driving transistor DTFT, the second threshold compensation sub-circuit 11, and the second output control sub-circuit 12 are coupled to a seventh node N7.

The second resetting sub-circuit 9 is configured to write a second initialization voltage to the fifth node N5 in response to control of a signal of a second reset signal line Reset_I.

The second data writing sub-circuit 10 is configured to write a second data voltage to the sixth node N6 in response to control of a signal of a second gate line Gate_I.

The second threshold compensation sub-circuit 11 is configured to perform threshold compensation on the driving transistor DTFT in response to control of the signal of the second gate line Gate_I.

The second output control sub-circuit 12 is coupled to the third node N3, and is configured to write a first operation voltage to the sixth node N6, and control the third node N3 and the seventh node N7 to be electrically coupled, in response to control of the signal of the control signal line EM.

The driving transistor DTFT is configured to output a corresponding driving current in response to control of a voltage at the fifth node N5; a first terminal of the second capacitor C2 is coupled to a first operation voltage terminal, and a second terminal of the second capacitor C2 is coupled to the fifth node N5.

In some implementations, the second resetting sub-circuit 9 includes a ninth transistor M9, the second data writing sub-circuit 10 includes a tenth transistor M10, the second threshold compensation sub-circuit 11 includes a eleventh transistor M11, and the second output control sub-circuit 12 includes a twelfth transistor M12 and a thirteenth transistor M13.

A control electrode of the ninth transistor M9 is coupled to the second reset signal line Reset_I, a first electrode of the ninth transistor M9 is coupled to the second initialization voltage terminal, and a second electrode of the ninth transistor M9 is coupled to the fifth node N5.

A control electrode of the tenth transistor M10 is coupled to the second gate line Gate_I, a first electrode of the tenth transistor M10 is coupled to the second data line Data_I, and a second electrode of the tenth transistor M10 is coupled to the sixth node N6.

A control electrode of the eleventh transistor M11 is coupled to the second gate line Gate_I, a first electrode of the eleventh transistor M11 is coupled to the fifth node N5, and a second electrode of the eleventh transistor M11 is coupled to the seventh node N7.

A control electrode of the twelfth transistor M12 is coupled to the control signal line EM, a first electrode of the twelfth transistor M12 is coupled to the first operation voltage terminal, and a second electrode of the twelfth transistor M12 is coupled to the sixth node N6.

A control electrode of the thirteenth transistor M13 is coupled to the control signal line EM, a first electrode of the thirteenth transistor M13 is coupled to the seventh node N7, and a second electrode of the thirteenth transistor M13 is coupled to the third node N3.

Figure 6:
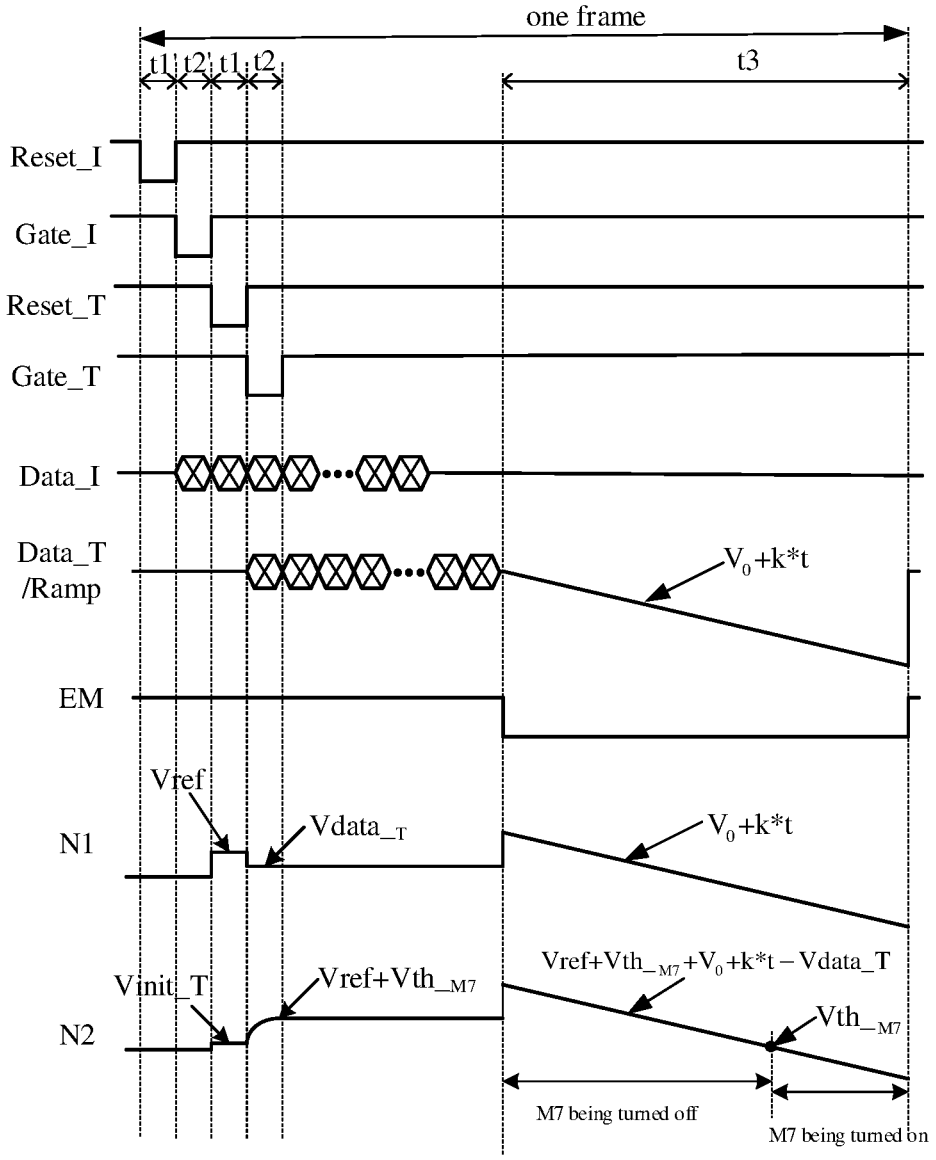
FIG. 6 is a timing diagram illustrating an operation of the pixel circuit shown in FIG. 5.

An operation of the pixel circuit shown in FIG. 5 will be described in detail below with reference to the accompanying drawing. FIG. 6 is a timing diagram illustrating an operation of the pixel circuit shown in FIG. 5, and as shown in FIG. 6, the operation of the pixel circuit includes the following stages including a second reset stage t1', a second writing and compensation stage t2', the first reset stage t1, the first writing and compensation stage t2 and the display stage t3.

In the second reset stage t1', the first reset signal provided by the first reset signal line Reset_T is at a high level, the first gate scan signal provided by the first gate line Gate_T is at a high level, a second reset signal provided by the second reset signal line Reset_I is at a low level, a second gate scan signal provided by the second gate line Gate_I is at a high level, and the control signal provided by the control signal line EM is at a high level. In such case, the ninth transistor M9 is turned on, and the first to eighth transistors M1 to M8 and the tenth to thirteenth transistors M10 to M13 are turned off. Since the ninth transistor M9 is turned on, the second initialization voltage Vinit_I is written to the fifth node N5 through the ninth transistor M9.

In the second writing and compensation stage t2', the first reset signal provided by the first reset signal line Reset_T is at a high level, the first gate scan signal provided by the first gate line Gate_T is at a high level, the second reset signal provided by the second reset signal line Reset_I is at a high level, the second gate scan signal provided by the second gate line Gate_I is at a low level, and the control signal provided by the control signal line EM is at a high level. In such case, the tenth transistor M10 and the eleventh transistor M11 are turned on, and the first to ninth transistors M1 to M9, the twelfth transistor M12, and the thirteenth transistor M13 are turned off. Since the tenth transistor M10 is turned on, a second data voltage Vdata_I is written to the sixth node N6 through the tenth transistor M10.

Since the eleventh transistor M11 is turned on, and the driving transistor DTFT forms a diode structure at this time, the sixth node N6 can charge the fifth node N5 through the driving transistor DTFT, the seventh node N7 and the eleventh transistor M11, and when the voltage at the fifth node N5 is charged to Vdata_I+$Vth_{_DTFT}$, the driving transistor DTFT is turned off, and the threshold compensation of the driving transistor DTFT is completed, where $Vth_{_DTFT}$ is the threshold voltage of the driving transistor DTFT (if the driving transistor DTFT is a P-type transistor, $Vth_{_DTFT}$ is a negative value).

In the first reset stage t1, the first reset signal provided by the first reset signal line Reset_T is at a low level, the first gate scan signal provided by the first gate line Gate_T is at a high level, the second reset signal provided by the second reset signal line Reset_I is at a high level, the second gate scan signal provided by the second gate line Gate_I is at a high level, and the control signal provided by the control signal line EM is at a high level. In such case, the first transistor M1 and the second transistor M2 are turned on, and the third to thirteenth transistors M3 to M13 are turned off.

In the first writing and compensation stage t2, the first reset signal provided by the first reset signal line Reset_T is at a high level, the first gate scan signal provided by the first gate line Gate_T is at a low level, the second reset signal provided by the second reset signal line Reset_I is at a high level, the second gate scan signal provided by the second gate line Gate_I is at a low level, and the control signal provided by the control signal line EM is at a high level. In such case, the third to fifth transistors M3 to M5 are turned on, and the first transistor M1, the second transistor M2, the sixth transistor M6, the eighth transistor M8, and the ninth to thirteenth transistors M9 to M13 are turned off. The seventh transistor M7 is turned on first and then turned off.

In the first resetting stage t1 and the first writing and compensation stage t2, each transistor in the current control circuit 1 is turned off. For the description of the operation of each transistor in the time control circuit 2, reference may be made to the corresponding contents in the foregoing embodiments, and details are not repeated here.

In the display stage t3, the first reset signal provided by the first reset signal line Reset_T is at a high level, the first gate scan signal provided by the first gate line Gate_T is at a high level, the second reset signal provided by the second reset signal line Reset_I is at a high level, the second gate scan signal provided by the second gate line Gate_I is at a high level, and the control signal provided by the control signal line EM is at a low level. In such case, the sixth transistor M6, the eighth transistor M8, the twelfth transistor M12, and the thirteenth transistor M13 are turned on, the first to fifth transistors M1 to M5 are turned on, and the ninth to eleventh transistors M9 to M11 are turned off. The seventh transistor M7 is turned off first and then turned on.

The driving transistor DTFT operates in a saturation stage, and it can be obtained the following equation according to the saturation current formula:

$$\begin{aligned} I_{_DTFT} &= K_{_DTFT} * (Vgs_{_DTFT} - Vth_{_DTFT})^2 \\ &= K_{_DTFT} * (\text{Vdata_I} + Vth_{_DTFT} - Vdd - Vth_{_DTFT})^2 \\ &= K_{_DTFT} * (\text{Vdata_I} - Vdd)^2 \end{aligned},$$

where $I_{_DTFT}$ is the current outputted by the driving transistor DTFT in the saturation state, $Vgs_{_DTFT}$ is a gate-source voltage of the driving transistor DTFT, and $K_{_DTFT}$ is a constant and determined by the electrical characteristics of the driving transistor DTFT. Therefore, under the condition that the first operation voltage Vdd is constant, the driving current output by the driving transistor DTFT is only related to the second data voltage Vdata_I and is not related to the threshold voltage $Vth_{_DTFT}$ of the driving transistor DTFT, so that the influence of nonuniformity and drift of the threshold voltage on the driving current output by the driving transistor DTFT can be avoided, and the uniformity of the driving current output by the driving transistor DTFT is effectively improved.

For the description of the operation of each transistor in the time control circuit 2, reference may be made to the corresponding contents in the foregoing embodiments, and details are not repeated here.

In the embodiment of the present disclosure, the driving current $I_{_DTFT}$ and the time duration of operation of the element (Micro-LED) to be driven can be controlled by the first data voltage Vdata_T and the second data voltage Vdata_I respectively, so as to control the display gray scale.

It should be noted that, in some implementations, the first reset stage t1 and the second reset stage t1' may be performed simultaneously, and the first writing and compensation stage t2 and the second writing and compensation stage t2' may be performed simultaneously, which is not shown by a timing diagram.

Figure 7:
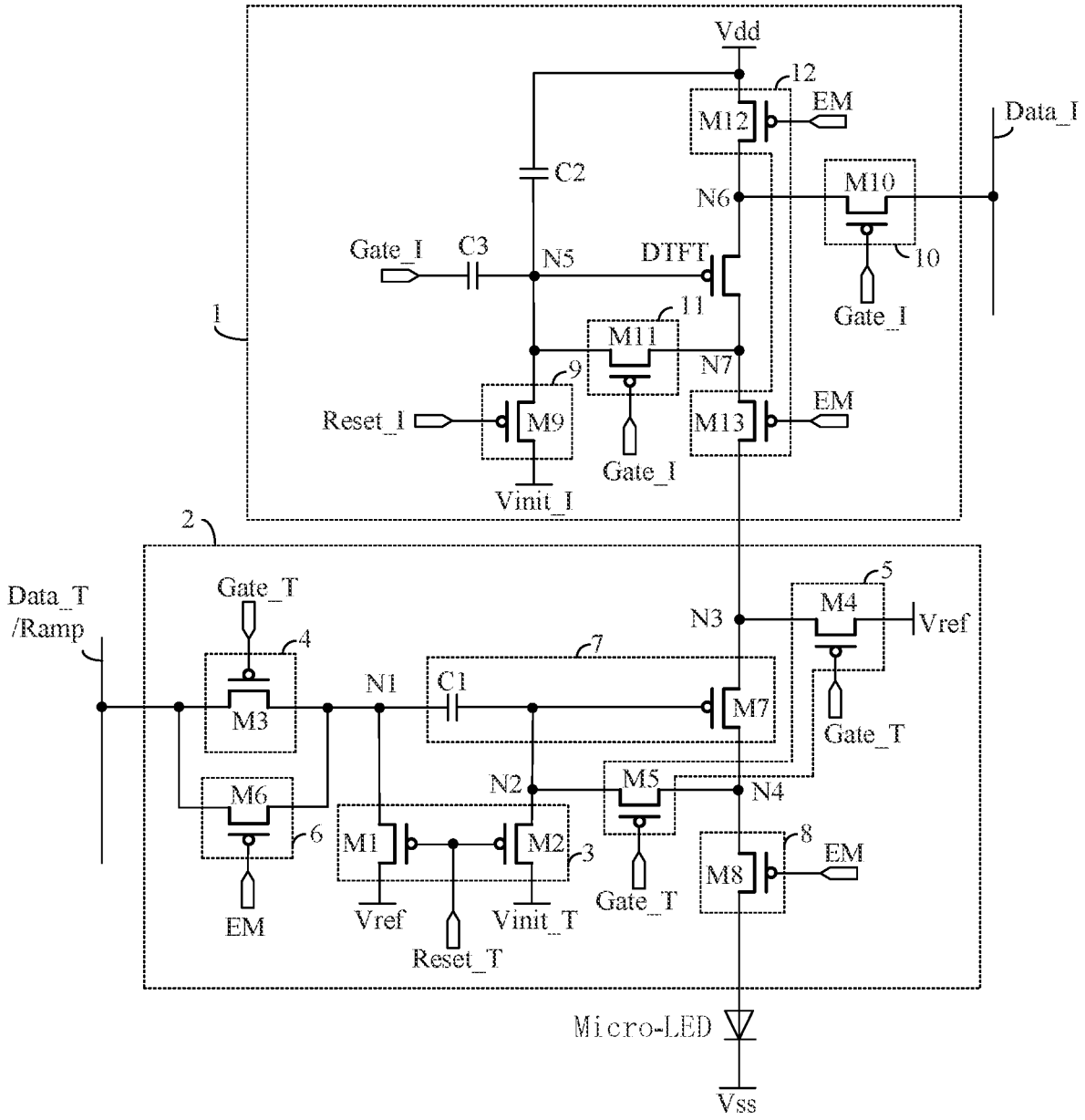
FIG. 7 is a schematic circuit diagram of a pixel circuit according to yet another embodiment of the present disclosure.

FIG. 7 is a schematic circuit diagram of a pixel circuit provided by yet another embodiment of the present disclosure, and as shown in FIG. 7, a difference between the pixel circuit shown in FIG. 7 and the pixel circuit shown in FIG. 5 is that, the current control circuit 1 in the pixel circuit shown in FIG. 7 further includes a third capacitor C3, a first terminal of the third capacitor C3 is coupled to the second gate line Gate_I, and a second terminal of the third capacitor C3 is coupled to the fifth node N5.

In practical applications, it is found that, during the second writing and compensation stage t2', the charging speed of the fifth node N5 depends on the driving transistor DTFT being turned on, which is controlled by a voltage difference between a gate and a source of the driving transistor DTFT, in such case, the voltage difference between the gate and the source of the driving transistor DTFT is V_N5−Vdata_I, where V_N5 is a value of voltage at the fifth node N5. As the threshold compensation progresses, the voltage of the fifth node N5 gradually approaches Vdata_I+$Vth_{_DTFT}$, and the closer to Vdata_I+$Vth_{_DTFT}$, the slower the charging speed of the fifth node N5 is, a case where the voltage of the fifth node N5 cannot be charged to Vdata_I+$Vth_{_DTFT}$ in a limited time (e.g., charging time 1H for a row of pixels) may occur. Assuming that at the end of the second writing and compensation stage t2', the difference between the voltage V_N5 at the fifth node N5 and Vdata_I+$Vth_{_DTFT}$ is ΔV, i.e., the fifth node N5 is charged to Vdata_I+$Vth_{_DTFT}$−ΔV. The differences in luminance caused by the difference voltage ΔV are different for different gray scales.

In order to compensate the difference voltage ΔV, the third capacitor C3 is employed in the present embodiment. When the second writing and compensation stage t2' ends, the second gate scan signal loaded on the second gate line Gate_I is switched from a low level to a high level, and at this time, the voltage at the fifth node N5 can be pulled up through the third capacitor C3, so that the compensation for the difference voltage ΔV can be realized. Specifically, assuming that a corresponding transition voltage is ΔVg when the second gate scan signal is switched from the low level to the high level, under the bootstrap effect of the third capacitor C3, the voltage at the fifth node N5 will be pulled up by (C3'×ΔVg)/(C2+C3). Let (C3'×ΔVg)/(C2+C3)=ΔV, resulting in a ratio C3/(C2+C3)=ΔV/ΔVg, and thus, when designing the circuit, capacitances of the second capacitor C2 and the third capacitor C3 are determined according to this ratio.

Typically, ΔVg is more than ten volts, e.g., is 14V; ΔV is only a few tenths of a volt, for example is 0.2V, and the value of C3/(C2+C3) shown by way of example is 0.2/14≈1.4%, because the capacitance of the third capacitor C3 is small, the addition of the third capacitor C3 does not affect the high pixel density (Pixels Per inch, PPI for short) while improving the display effect.

Figure 8:
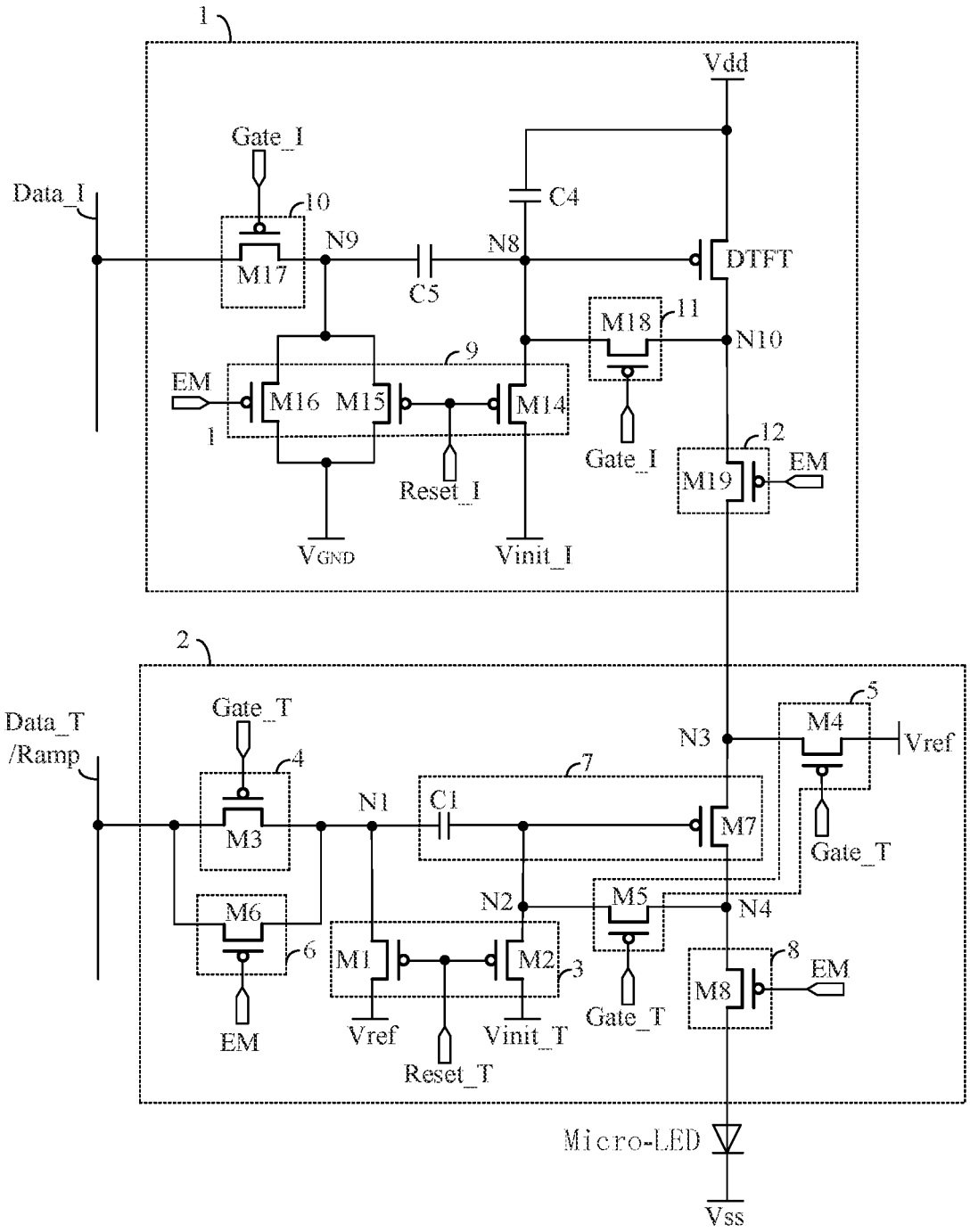
FIG. 8 is a schematic circuit diagram of a pixel circuit according to yet another embodiment of the present disclosure.

FIG. 8 is a schematic circuit diagram of a pixel circuit provided in yet another embodiment of the present disclosure, and as shown in FIG. 8, the circuit structure of the current control circuit 1 in the pixel circuit provided in this embodiment is different from that in the forgoing embodiments. Here, it is assumed that a constant voltage provided from a constant voltage terminal is a ground voltage $V_{GND}$.

In some implementations, the current control circuit 1 includes: a second resetting sub-circuit 9, a second data writing sub-circuit 10, a second threshold compensation sub-circuit 11, a second output control sub-circuit 12, a driving transistor DTFT, a fourth capacitor C4, and a fifth capacitor C5, where the control electrode of the driving transistor DTFT, the second threshold compensation sub-circuit 11, and the second resetting sub-circuit 9 are coupled to an eighth node N8, the second resetting sub-circuit 9 and the second data writing sub-circuit 10 are coupled to a ninth node N9, and the second electrode of the driving transistor DTFT, the second threshold compensation sub-circuit 11 and the second output control sub-circuit 12 are coupled to a tenth node N10.

The second resetting sub-circuit 9 is configured to write a second initialization voltage and a preset constant voltage to the eighth node N8 and the ninth node N9, respectively, in response to control of a signal of the second reset signal line reset_I, and to write the preset constant voltage to the ninth node N9 in response to control of a signal of the control signal line EM.

The second data writing sub-circuit 10 is configured to write a second data voltage to the ninth node N9 in response to control of a signal of a second gate line Gate_I.

The second threshold compensation sub-circuit 11 is configured to perform threshold compensation on the driving transistor DTFT in response to control of the signal of the second gate line Gate_I.

The second output control sub-circuit 12 is coupled to the third node N3, and is configured to control the third node N3 and the tenth node N10 to be electrically coupled, in response to control of the signal of the control signal line EM.

The driving transistor DTFT is configured to output a corresponding driving current in response to control of a voltage at the eighth node N8. A first terminal of the fourth capacitor C4 is coupled to the first operation voltage terminal, and a second terminal of the fourth capacitor C4 is coupled to the eighth node N8; a first terminal of the fifth capacitor C5 is coupled to the ninth node N9, and a second terminal of the fifth capacitor C5 is coupled to the eighth node N8.

In some implementations, the second resetting sub-circuit 9 includes a fourteenth transistor M14, a fifteenth transistor M15, and a sixteenth transistor M16, the second data writing sub-circuit 10 includes a seventeenth transistor M17, the second threshold compensation sub-circuit 11 includes a eighteenth transistor M18, the second output control sub-circuit 12 includes a nineteenth transistor M19.

A control electrode of the fourteenth transistor M14 is coupled to the second reset signal line Reset_I, a first electrode of the fourteenth transistor M14 is coupled to a second initialization voltage terminal, and a second electrode of the fourteenth transistor M14 is coupled to the eighth node N8.

A control electrode of the fifteenth transistor M15 is coupled to the second reset signal line Reset_I, a first electrode of the fifteenth transistor M15 is coupled to the constant voltage terminal, and a second electrode of the fifteenth transistor M15 is coupled to the ninth node N9.

A control electrode of the sixteenth transistor M16 is coupled to the control signal line EM, a first electrode of the sixteenth transistor M16 is coupled to the constant voltage terminal, and a second electrode of the sixteenth transistor M16 is coupled to the ninth node N9.

A control electrode of the seventeenth transistor M17 is coupled to the second gate line Gate_I, a first electrode of the seventeenth transistor M17 is coupled to the second data line Data_I, and a second electrode of the seventeenth transistor M17 is coupled to the ninth node N9.

A control electrode of the eighteenth transistor M18 is coupled to the second gate line Gate_I, a first electrode of the eighteenth transistor M18 is coupled to the eighth node N8, and a second electrode of the eighteenth transistor M18 is coupled to the tenth node N10.

A control electrode of the nineteenth transistor M19 is coupled to the control signal line EM, a first electrode of the nineteenth transistor M19 is coupled to the tenth node N10, and a second electrode of the nineteenth transistor M19 is coupled to the third node N3.

An operation of the pixel circuit shown in FIG. 8 will be described in detail below with reference to FIG. 6. Referring to FIG. 6 again, as shown in FIG. 6, the operation of the pixel circuit includes the following stages the second reset stage t1', the second writing and compensation stage t2', the first reset stage t1, the first writing and compensation stage t2 and the display stage t3.

In the second reset stage t1', the first reset signal provided by the first reset signal line Reset_T is at a high level, the first gate scan signal provided by the first gate line Gate_T is at a high level, the second reset signal provided by the second reset signal line Reset_I is at a low level, the second gate scan signal provided by the second gate line Gate_I is at a high level, and the control signal provided by the control signal line EM is at a high level. In such case, the fourteenth transistor M14 and the fifteenth transistor M15 are turned on, and the first transistor M1 to the eighth transistor M8 and the sixteenth transistor M16 to the nineteenth transistor M19 are turned off. Since the fourteenth transistor M14 and the fifteenth transistor M15 are turned on, a second initialization voltage Vinit_I and the ground voltage $V_{GND}$ are respectively written into the eighth node N8 and the ninth node N9 through the fourteenth transistor M14 and the fifteenth transistor M15, and a voltage difference between two terminals of the fifth capacitor C5 is Vinit_I−$V_{GND}$.

In the second writing and compensation stage t2', the first reset signal provided by the first reset signal line Reset_T is at a high level, the first gate scan signal provided by the first gate line Gate_T is at a high level, the second reset signal provided by the second reset signal line Reset_I is at a high level, the second gate scan signal provided by the second gate line Gate_I is at a low level, and the control signal provided by the control signal line EM is at a high level. In such case, the seventeenth transistor M17 and the eighteenth transistor M18 are turned on, and the first to eighth transistors M1 to M8, the fourteenth to sixteenth transistors M14 to M16, and the nineteenth transistor M19 are turned off. Since the seventeenth transistor M17 is turned on, the second data voltage Vdata_I is written to the ninth node N9 through the seventeenth transistor M17.

Since the eighteenth transistor M18 is turned on, and the driving transistor DTFT forms a diode structure at this time, the first operation voltage terminal can charge the eighth node N8 through the driving transistor DTFT, the tenth node N10 and the eighteenth transistor M18, and when the voltage at the eighth node N8 is charged to Vdd+$Vth_{_DTFT}$, the driving transistor DTFT is turned off, so that the threshold compensation of the driving transistor DTFT is completed, where $Vth_{_DTFT}$ is the threshold voltage of the driving transistor DTFT.

At the end of the second writing and compensation stage t2', the voltage at the eighth node N8 is Vdd+$Vth_{_DTFT}$, the voltage at the ninth node N9 is Vdata_I, and a voltage difference between two terminals of the fifth capacitor C5 is Vdd+$Vth_{_DTFT}$−Vdata_I.

In the first reset stage t1, the first reset signal provided by the first reset signal line Reset_T is at a low level, the first gate scan signal provided by the first gate line Gate_T is at a high level, the second reset signal provided by the second reset signal line Reset_I is at a high level, the second gate scan signal provided by the second gate line Gate_I is at a high level, and the control signal provided by the control signal line EM is at a high level. In such case, the first transistor M1 and the second transistor M2 are turned on, and the third transistor M3 to the eighth transistor M8 and the fourteenth transistor M14 to the nineteenth transistor M19 are turned off.

In the first writing and compensation stage t2, the first reset signal provided by the first reset signal line Reset_T is at a high level, the first gate scan signal provided by the first gate line Gate_T is at a low level, the second reset signal provided by the second reset signal line Reset_I is at a high level, the second gate scan signal provided by the second gate line Gate_I is at a low level, and the control signal provided by the control signal line EM is at a high level. In such case, the third to fifth transistors M3 to M5 are turned on, and the first transistor M1, the second transistor M2, the sixth transistor M6, the eighth transistor M8, and the fourteenth to nineteenth transistors M14 to M19 are turned off. The seventh transistor M7 is turned on first and then turned off.

In the first reset stage t1 and the first writing and compensation stage t2, each transistor in the current control circuit 1 is turned off. For the description of the operation of each transistor in the time control circuit 2, reference may be made to the corresponding contents in the foregoing embodiments, and details are not repeated here.

In the display stage t3, the first reset signal provided by the first reset signal line Reset_T is at a high level, the first gate scan signal provided by the first gate line Gate_T is at a high level, the second reset signal provided by the second reset signal line Reset_I is at a high level, the second gate scan signal provided by the second gate line Gate_I is at a high level, and the control signal provided by the control signal line EM is at a low level. In such case, the sixth transistor M6, the eighth transistor M8, the sixteenth transistor M16, and the nineteenth transistor M19 are turned on, and the first to fifth transistors M1 to M5 are turned on, and the fourteenth transistor M14, the fifteenth transistor M15, the seventeenth transistor M17, and the eighteenth transistor M18 are turned off. The seventh transistor M7 is turned off first and then turned on.

Since the sixteenth transistor M16 is turned on, the ground voltage $V_{GND}$ is written to the ninth node N9 through the sixteenth transistor M16, and the voltage at the eighth node N8 jumps from Vdd+Vth$_{_L}$m to Vdd+Vth$_{_DTFT}$+$V_{GND}$−Vdata_I under the bootstrap action of the fifth capacitor C5.

The driving transistor DTFT operates in a saturation state, and the following equation can be obtained according to the saturation current formula:

$$\begin{aligned} I_{_DTFT} &= K_{_DTFT} * (Vgs_{_DTFT} - Vth_{_DTFT})^2 \quad , \\ &= K_{_DTFT} * (Vdd + Vth_{_DTFT} + V_{GND} - \\ &\quad \text{Vdata_I} - Vdd - Vth_{_DTFT})^2 \\ &= K_{_DTFT} * (V_{GND} - \text{Vdata_I})^2 \end{aligned}$$

where $I_{_DTFT}$ is the current outputted by the driving transistor DTFT in the saturation state, $Vgs_{_DTFT}$ is a gate-source voltage of the driving transistor DTFT, and $K_{_DTFT}$ is a constant and determined by the electrical characteristics of the driving transistor DTFT. Therefore, under the condition that the ground voltage $V_{GND}$ is constant, the driving current output by the driving transistor DTFT is only related to the second data voltage Vdata_I and is not related to the threshold voltage Vth$_{_DTFT}$ of the driving transistor DTFT, and thus the influence of nonuniformity and drift of the threshold voltage on the driving current output by the driving transistor DTFT can be avoided, and the uniformity of the driving current output by the driving transistor DTFT is effectively improved.

For the description of the operation of each transistor in the time control circuit 2, reference may be made to the corresponding contents in the foregoing embodiments, and details are not repeated here.

In the embodiment of the present disclosure, the driving current $I_{_DTFT}$ and the time duration of operation of the element to be driven can be controlled by the first data voltage Vdata_T and the second data voltage Vdata_I respectively, so as to control the display gray scale.

It should be noted that, the operations of the pixel circuit with all the transistors being N-type transistors in this embodiment are the same as those of the pixel circuit with all the transistors being P-type transistors, which is not described herein again.

Those ordinary skilled in the art should understand that the current control circuit in the present embodiment may adopt other circuit structures, which are not described here by way of example.

Figure 9:
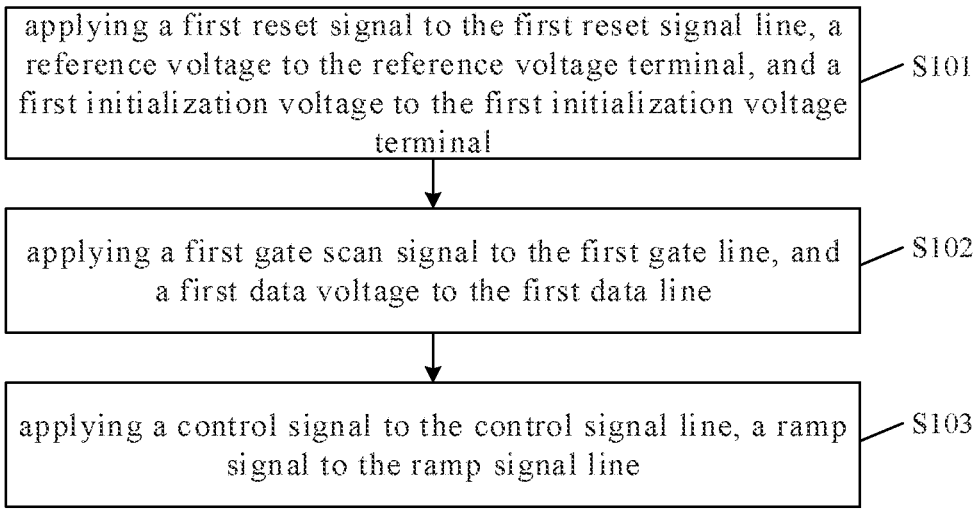
FIG. 9 is a flowchart of a driving method of a pixel circuit according to an embodiment of the present disclosure.

FIG. 9 is a flowchart of a driving method of a pixel circuit according to an embodiment of the present disclosure, and as shown in FIG. 9, the pixel circuit is the pixel circuit according to any one of the foregoing embodiments, and the driving method includes following steps S101 to S103.

Step S101, applying a first reset signal to the first reset signal line, a reference voltage to the reference voltage terminal, and a first initialization voltage to the first initialization voltage terminal, so that the first resetting sub-circuit writes the reference voltage and the first initialization voltage to the first node and the second node, respectively, in response to control of the reset signal.

Step S102, applying a first gate scan signal to the first gate line, and a first data voltage to the first data line, so that the first data writing sub-circuit writes the first data voltage to the first node in response to control of the first gate scan signal, and the first threshold compensation sub-circuit performs threshold compensation on a transistor in the switch sub-circuit in response to control of the first gate scan signal.

Step S103, applying a control signal to the control signal line, a ramp signal to the ramp signal line, so that the ramp writing sub-circuit writes the ramp signal to the first node in response to control of the control signal, and the switch sub-circuit adjusts the voltage at the second node according to a voltage difference between the voltage of the ramp signal applied at the first node and the first data voltage, and controls electrical coupling and decoupling between the third node and the fourth node in response to control of the voltage at the second node.

For the specific description of the above steps S101 to S103, reference may be made to corresponding contents in the described embodiments, which are not described herein again.

Figure 10:
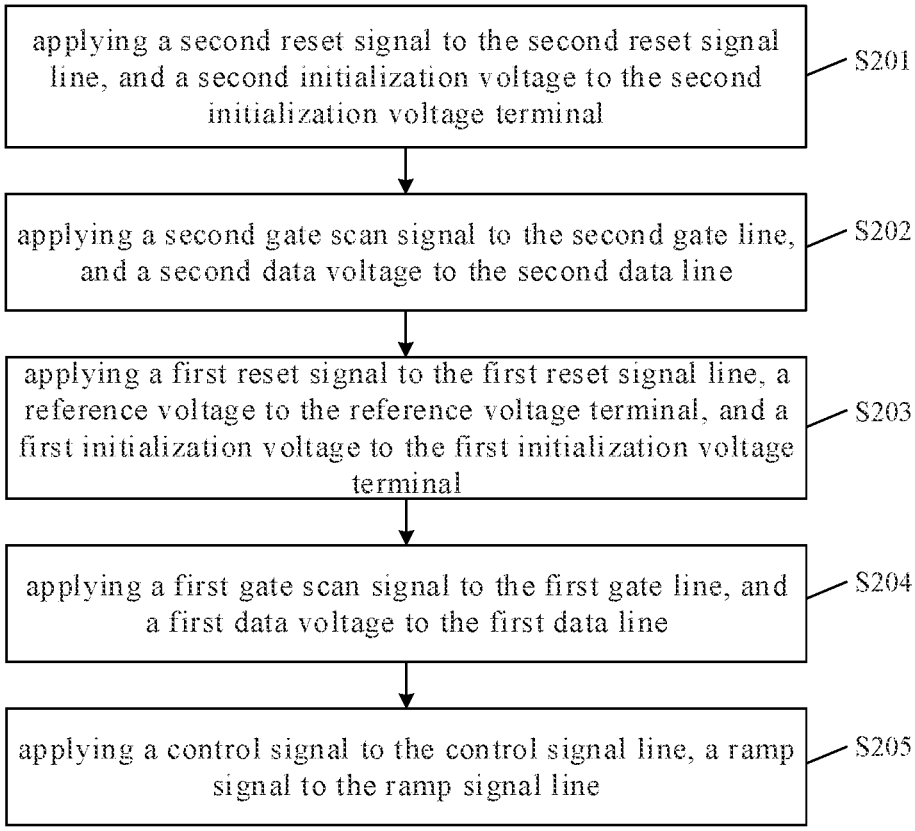
FIG. 10 is a flowchart of a driving method of a pixel circuit according to another embodiment of the present disclosure.

FIG. 10 is a flowchart of a driving method of a pixel circuit according to another embodiment of the present disclosure, and as shown in FIG. 10, the current control circuit in the pixel circuit includes: a second resetting sub-circuit, a second data writing sub-circuit, a second threshold compensation sub-circuit, a second output control sub-circuit, a driving transistor and a second capacitor; for example, the current control circuit shown in FIG. 5 and FIG. 7 is employed. The driving method includes following steps S201 to S205.

Step S201, applying a second reset signal to the second reset signal line, and a second initialization voltage to the second initialization voltage terminal, so that the second resetting sub-circuit applies the second initialization voltage to the fifth node in response to control of the second reset signal.

Step S202, applying a second gate scan signal to the second gate line, and a second data voltage to the second data line, so that the second data writing sub-circuit writes the second data voltage to the sixth node in response to control of the second gate scan signal, and the second threshold compensation sub-circuit performs threshold compensation on the driving transistor in response to control of the second gate scan signal.

Step S203, applying a first reset signal to the first reset signal line, a reference voltage to the reference voltage terminal, and a first initialization voltage to the first initialization voltage terminal, so that the first resetting sub-circuit writes the reference voltage and the first initialization voltage to the first node and the second node, respectively, in response to control of the reset signal.

Step S204, applying a first gate scan signal to the first gate line, and a first data voltage to the first data line, so that the first data writing sub-circuit writes the first data voltage to the first node in response to control of the first gate scan signal, and the first threshold compensation sub-circuit performs threshold compensation on a transistor in the switch sub-circuit in response to control of the first gate scan signal.

Step S205, applying a control signal to the control signal line, a ramp signal to the ramp signal line, so that the second output control sub-circuit writes a first operation voltage to the sixth node in response to control of the control signal, and controls the third node and the seventh node to be electrically coupled, the driving transistor outputs a corresponding driving current in response to control of the voltage at the fifth node, the ramp writing sub-circuit writes the ramp signal to the first node in response to control of the control signal, and the switch sub-circuit adjusts the voltage at the second node according to a voltage difference between the voltage of the ramp signal applied at the first node and the first data voltage, and controls electrical coupling and decoupling between the third node and the fourth node in response to control of the voltage at the second node.

For the specific description of the above steps S201 to S205, reference may be made to corresponding contents in the above described embodiments, which are not described herein again.

In some implementations, steps S201 and S203 may be performed synchronously, and steps S202 and S204 may be performed synchronously.

Figure 11:
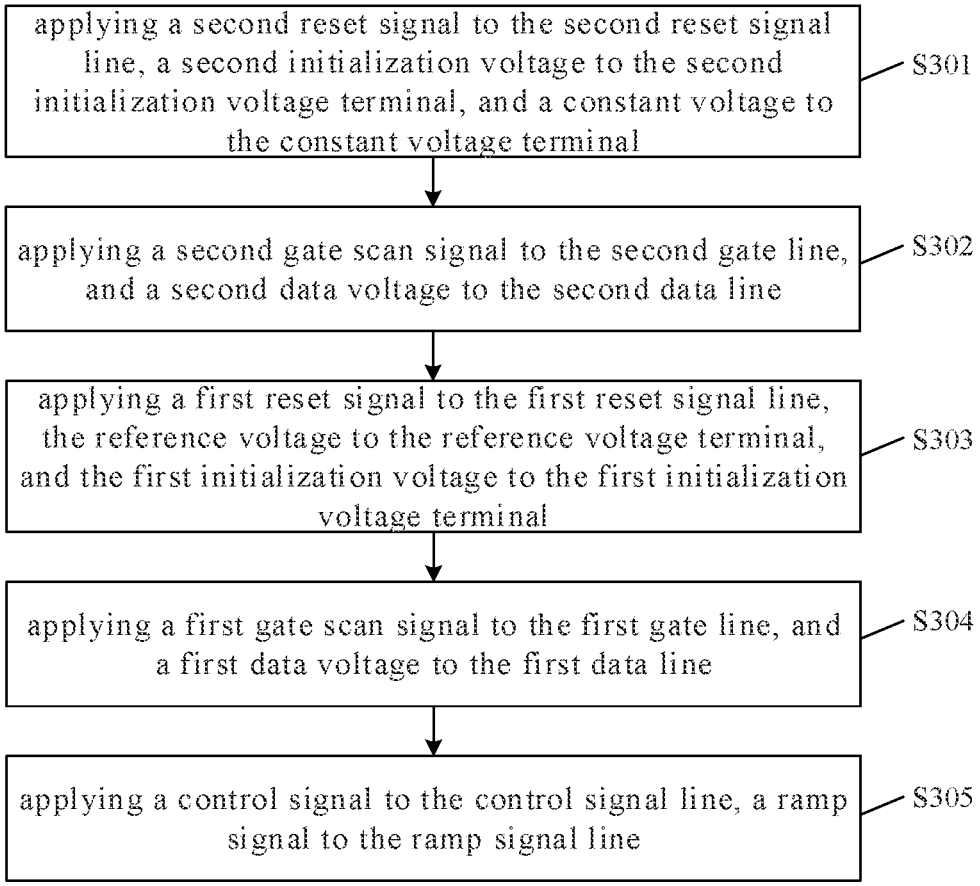
FIG. 11 is a flowchart of a driving method of a pixel circuit according to further another embodiment of the present disclosure.

FIG. 11 is a flowchart of a driving method of a pixel circuit according to yet another embodiment of the present disclosure, and as shown in FIG. 11, the current control circuit in the pixel circuit includes a second resetting sub-circuit, a second data writing sub-circuit, a second threshold compensation sub-circuit, a second output control sub-circuit, a driving transistor, a fourth capacitor and a fifth capacitor, the driving method includes following steps S301 to S305.

Step S301, applying a second reset signal to the second reset signal line, a second initialization voltage to the second initialization voltage terminal, and a constant voltage to the constant voltage terminal, so that the second resetting sub-circuit applies the second initialization voltage and the constant voltage to the eighth node and the ninth node respectively in response to control of the second reset signal.

Step S302, applying a second gate scan signal to the second gate line, and a second data voltage to the second data line, so that the second data writing sub-circuit writes the second data voltage to the ninth node in response to control of the second gate scan signal, and the second threshold compensation sub-circuit performs threshold compensation on the driving transistor in response to control of the second gate scan signal.

Step S303, applying a first reset signal to the first reset signal line, the reference voltage to the reference voltage terminal, and the first initialization voltage to the first initialization voltage terminal, so that the first resetting sub-circuit writes the reference voltage and the first initialization voltage to the first node and the second node, respectively, in response to control of the reset signal.

Step S304, applying a first gate scan signal to the first gate line, and a first data voltage to the first data line, so that the first data writing sub-circuit writes the first data voltage to the first node in response to control of the first gate scan signal, and the first threshold compensation sub-circuit performs threshold compensation on a transistor in the switch sub-circuit in response to control of the first gate scan signal.

Step S305, applying a control signal to the control signal line, a ramp signal to the ramp signal line, so that the second resetting sub-circuit writes a constant voltage into the ninth node in response to control of the control signal, the second output control sub-circuit controls the third node and the tenth node to be electrically coupled, in response to control of the control signal, the driving transistor outputs a corresponding driving current in response to control of the voltage at the eighth node, the ramp writing sub-circuit writes a ramp signal into the first node in response to control of the control signal, the switch sub-circuit adjusts the voltage at the second node according to a voltage difference between the voltage of the ramp signal applied at the first node and the first data voltage, and controls electrical coupling and decoupling between the third node and the fourth node in response to control of the voltage at the second node.

For the specific description of the above steps S301 to S305, reference may be made to corresponding contents in the above described embodiments, which is not described herein again.

In some implementations, steps S301 and S303 may be performed synchronously, and steps S302 and S304 may be performed synchronously.

Figure 12:
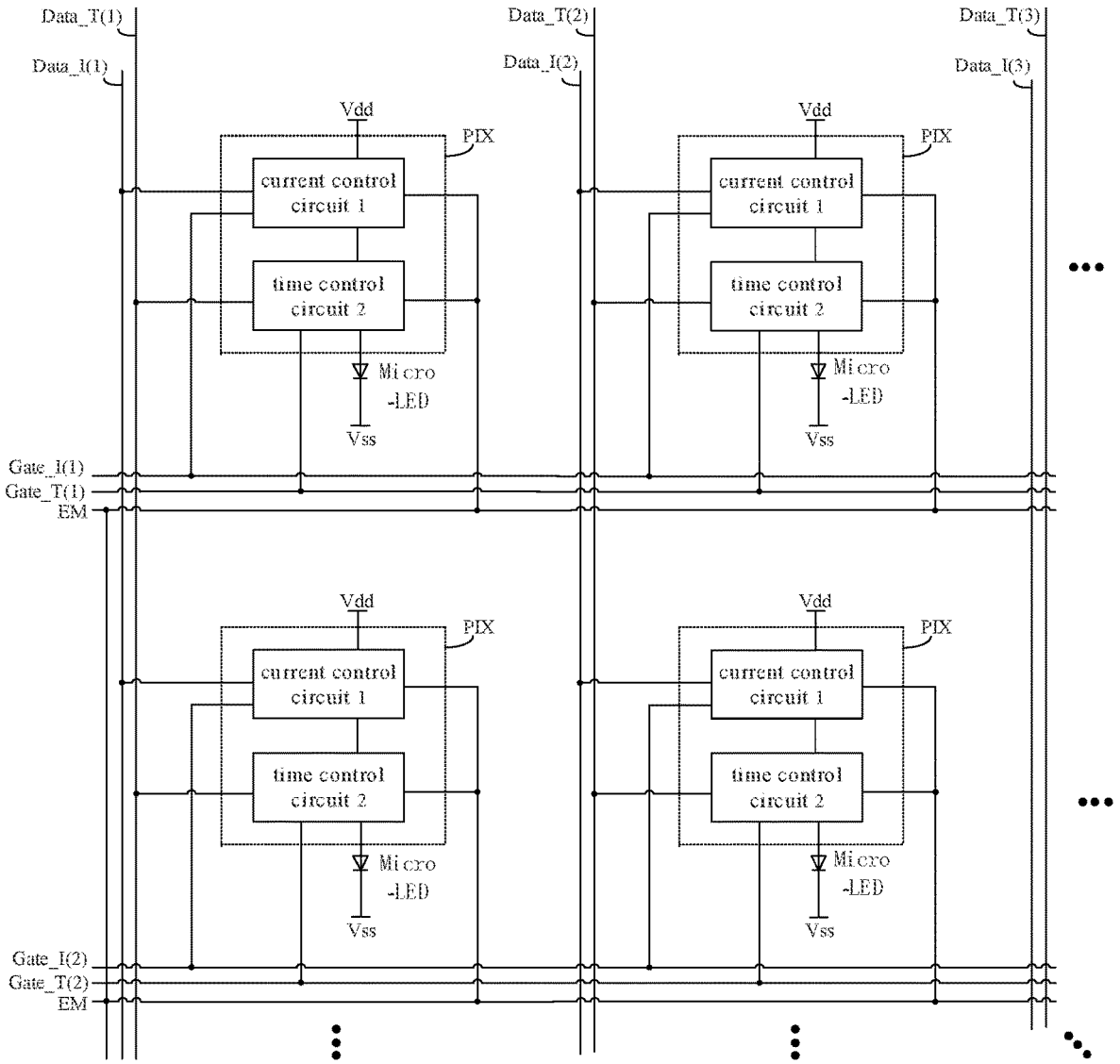
FIG. 12 is a schematic circuit diagram of a display device according to an embodiment of the present disclosure.

FIG. 12 is a schematic circuit diagram of a display device according to an embodiment of the present disclosure, and as shown in FIG. 12, the display device includes a display substrate including a plurality of sub-pixels, where at least one of the sub-pixels is provided therein with the pixel circuit PIX provided in the forgoing embodiments and an element (Micro-LED) to be driven, and the pixel circuit PIX is used for providing a driving signal for the element to be driven.

In some implementations, the element to be driven includes: an LED or a Micro-LED.

In some implementations, the number of sub-pixels is greater than or equal to 2; it should be noted that, 2×2 sub-pixels are exemplarily shown in FIG. 12, and this case is only for exemplary purposes and does not limit the technical solution of the present disclosure.

In some implementations, in a pixel array formed by a plurality of sub-pixels, the sub-pixels located in a same row correspond to a same first gate line Gate_T (1)/Gate_T (2) and a same second gate line Gate_I (1)/Gate_I (2), the sub-pixels located in a same column correspond to a same first data line Data_T (1)/Data_T (2) and a same second data line Data_I (1)/Data_I (2), and all the sub-pixels correspond to a same control signal line EM. It should be noted that, the above cases are only exemplary, and do not limit the technical solution of the present disclosure.

The display device provided by the embodiment of the present disclosure may be any product or component with a display function, such as electronic paper, an LED panel, a mobile phone, a tablet computer, a television, a display, a notebook computer, a digital photo frame, and a navigator.

It will be understood that the above embodiments are merely exemplary embodiments adopted to illustrate the principles of the present invention, and the present invention is not limited thereto. It will be apparent to those ordinary skilled in the art that various modifications and improvements can be made without departing from the spirit and scope of the present disclosure, and such modifications and improvements are considered to be within the scope of the present disclosure.

The invention claimed is:

1. A pixel circuit, comprising: a current control circuit and a time control circuit, the current control circuit is configured to generate a driving current and output the driving current to the time control circuit, wherein the time control circuit comprises: a first resetting sub-circuit, a first data writing sub-circuit, a first threshold compensation sub-circuit, a ramp writing sub-circuit and a switch sub-circuit, the first resetting sub-circuit, the first data writing sub-circuit and the ramp writing sub-circuit and the switch sub-circuit are coupled to a first node, the first resetting sub-circuit, the first threshold compensation sub-circuit and the switch sub-circuit are coupled to a second node, the first threshold compensation sub-circuit, the switch sub-circuit and the current control circuit are coupled to a third node, and the first threshold compensation sub-circuit, the switch sub-circuit and an element to be driven are coupled to a fourth node;

the first resetting sub-circuit is configured to write a reference voltage and a first initialization voltage to the first node and the second node, respectively, in response to control of a signal of a first reset signal line;

the first data writing sub-circuit is configured to write a first data voltage to the first node in response to control of a signal of a first gate line;

the first threshold compensation sub-circuit is configured to write the reference voltage to the third node and perform threshold compensation on a transistor within the switch sub-circuit in response to control of the signal of the first gate line;

the ramp writing sub-circuit is configured to write a preset ramp signal to the first node in response to control of a signal of a control signal line;

the switch sub-circuit is configured to adjust a voltage at the second node according to a voltage difference between a voltage of the ramp signal loaded at the first node and the first data voltage, and to control electrical coupling and decoupling between the third node and the fourth node in response to control of the voltage at the second node.

2. The pixel circuit of claim 1, wherein the first resetting sub-circuit comprises: a first transistor and a second transistor, a control electrode of the first transistor is coupled to the first reset signal line, a first electrode of the first transistor is coupled to a reference voltage terminal, and a second electrode of the first transistor is coupled to the first node;

a control electrode of the second transistor is coupled to the first reset signal line, a first electrode of the second transistor is coupled to the first initialization voltage terminal, and a second electrode of the second transistor is coupled to the second node.

3. The pixel circuit of claim 2, wherein the first data writing sub-circuit comprises: a third transistor, a control electrode of the third transistor is coupled to the first gate line, a first electrode of the third transistor is coupled to a first data line, and a second electrode of the third transistor is coupled to the first node.

4. The pixel circuit of claim 3, wherein the first threshold compensation sub-circuit comprises: a fourth transistor and a fifth transistor, a control electrode of the fourth transistor is coupled to the first gate line, a first electrode of the fourth transistor is coupled to a reference voltage terminal, and a second electrode of the fourth transistor is coupled to the third node;

a control electrode of the fifth transistor is coupled to the first gate line, a first electrode of the fifth transistor is coupled to the second node, and a second electrode of the fifth transistor is coupled to the fourth node.

5. The pixel circuit of claim 4, wherein the ramp writing sub-circuit comprises: a sixth transistor, a control electrode of the sixth transistor is coupled to the control signal line, a first electrode of the sixth transistor is coupled to a ramp signal line, and a second electrode of the sixth transistor is coupled to the first node.

6. The pixel circuit of claim 5, wherein the switch sub-circuit comprises: a seventh transistor and a first capacitor, a control electrode of the seventh transistor is coupled to the second node, a first electrode of the seventh transistor is coupled to the third node, and a second electrode of the seventh transistor is coupled to the fourth node;

a first terminal of the first capacitor is coupled to the first node, and a second terminal of the first capacitor is coupled to the second node.

7. The pixel circuit of claim 6, further comprising: a first output control sub-circuit configured to couple the element to be driven to the fourth node;

the first output control sub-circuit is configured to control electrical coupling and decoupling between the fourth node and the element to be driven in response to control of a signal of the control signal line.

8. The pixel circuit of claim 7, wherein the first output control sub-circuit comprises: an eighth transistor, a control electrode of the eighth transistor is coupled to the control signal line, a first electrode of the eighth transistor is coupled to the fourth node, and a second electrode of the eighth transistor is coupled to the element to be driven.

9. The pixel circuit of claim 1, wherein a signal line which supplies the first data voltage to the first data writing sub-circuit and a signal line which supplies the ramp signal to the ramp writing sub-circuit are shared.

10. The pixel circuit of claim 1, wherein the current control circuit comprises: a second resetting sub-circuit, a second data writing sub-circuit, a second threshold compensation sub-circuit, a second output control sub-circuit, a driving transistor and a second capacitor, the second resetting sub-circuit, a control electrode of the driving transistor and the second threshold compensation sub-circuit are coupled to a fifth node, a first electrode of the driving transistor, the second data write sub-circuit and the second output control sub-circuit are coupled to a sixth node, and a second electrode of the driving transistor, the second threshold compensation sub-circuit and the second output control sub-circuit are coupled to a seventh node;

the second resetting sub-circuit is configured to write a second initialization voltage to the fifth node in response to control of a signal of a second reset signal line;

the second data writing sub-circuit is configured to write a second data voltage to the sixth node in response to control of a signal of a second gate line;

the second threshold compensation sub-circuit is configured to perform threshold compensation on the driving transistor in response to control of the signal of the second gate line;

the second output control sub-circuit is coupled to the third node, and is configured to write a first operation voltage into the sixth node, and control the third node and the seventh node to be electrically coupled, in response to control of the signal of the control signal line, the driving transistor is configured to output a corresponding driving current in response to control of a voltage at the fifth node;

a first terminal of the second capacitor is coupled to a first operation voltage terminal, and a second terminal of the second capacitor is coupled to the fifth node.

11. The pixel circuit of claim 10, wherein the second resetting sub-circuit comprises a ninth transistor, the second data writing sub-circuit comprises a tenth transistor, the second threshold compensation sub-circuit comprises an eleventh transistor, the second output control sub-circuit comprises a twelfth transistor and a thirteenth transistor;

a control electrode of the ninth transistor is coupled to the second reset signal line, a first electrode of the ninth transistor is coupled to a second initialization voltage terminal, and a second electrode of the ninth transistor is coupled to the fifth node;

a control electrode of the tenth transistor is coupled to the second gate line, a first electrode of the tenth transistor is coupled to a second data line, and a second electrode of the tenth transistor is coupled to the sixth node;

a control electrode of the eleventh transistor is coupled to the second gate line, a first electrode of the eleventh transistor is coupled to the fifth node, and a second electrode of the eleventh transistor is coupled to the seventh node;

a control electrode of the twelfth transistor is coupled to the control signal line, a first electrode of the twelfth transistor is coupled to the first operation voltage terminal, and a second electrode of the twelfth transistor is coupled to the sixth node;

a control electrode of the thirteenth transistor is coupled to the control signal line, a first electrode of the thirteenth transistor is coupled to the seventh node, and a second electrode of the thirteenth transistor is coupled to the third node.

12. The pixel circuit of claim 11, wherein the current control circuit further comprises a third capacitor, a first terminal of the third capacitor is coupled to the second gate line, and a second terminal of the third capacitor is coupled to the fifth node.

13. The pixel circuit of claim 1, wherein the current control circuit comprises: a second resetting sub-circuit, a second data writing sub-circuit, a second threshold compensation sub-circuit, a second output control sub-circuit, a driving transistor, a fourth capacitor, and a fifth capacitor, wherein a control electrode of the driving transistor, the second threshold compensation sub-circuit, and the second resetting sub-circuit are coupled to an eighth node, the second resetting sub-circuit and the second data writing sub-circuit are coupled to a ninth node, and a second electrode of the driving transistor, the second threshold compensation sub-circuit, and the second output control sub-circuit are coupled to a tenth node;

the second resetting sub-circuit is configured to write a second initialization voltage and a preset constant voltage to the eighth node and the ninth node, respectively, in response to control of a signal of the second reset signal line, and write the preset constant voltage to the ninth node in response to control of the signal of the control signal line;

the second data writing sub-circuit is configured to write a second data voltage to the ninth node in response to control of a signal of the second gate line;

the second threshold compensation sub-circuit is configured to perform threshold compensation on the driving transistor in response to control of the signal of the second gate line;

the second output control sub-circuit is coupled to the third node and is configured to control the third node and the tenth node to be electrically coupled, in response to control of the signal of the control signal line;

the driving transistor is configured to output a corresponding driving current in response to control of a voltage at the eighth node;

a first terminal of the fourth capacitor is coupled to a first operation voltage terminal, and a second terminal of the fourth capacitor is coupled to the eighth node;

a first terminal of the fifth capacitor is coupled to the ninth node, and a second terminal of the fifth capacitor is coupled to the eighth node.

14. The pixel circuit of claim 13, wherein the second resetting sub-circuit comprises: a fourteenth transistor, a fifteenth transistor, and a sixteenth transistor, the second data writing sub-circuit comprises a seventeenth transistor, the second threshold compensation sub-circuit comprises an eighteenth transistor, the second output control sub-circuit comprises a nineteenth transistor;

a control electrode of the fourteenth transistor is coupled to the second reset signal line, a first electrode of the fourteenth transistor is coupled to a second initialization voltage terminal, and a second electrode of the fourteenth transistor is coupled to the eighth node;

a control electrode of the fifteenth transistor is coupled to the second reset signal line, a first electrode of the fifteenth transistor is coupled to a constant voltage terminal, and a second electrode of the fifteenth transistor is coupled to the ninth node;

a control electrode of the sixteenth transistor is coupled to the control signal line, a first electrode of the sixteenth transistor is coupled to the constant voltage terminal, and a second electrode of the sixteenth transistor is coupled to the ninth node;

a control electrode of the seventeenth transistor is coupled to the second gate line, a first electrode of the seventeenth transistor is coupled to the second data line, and a second electrode of the seventeenth transistor is coupled to the ninth node;

a control electrode of the eighteenth transistor is coupled to the second gate line, a first electrode of the eighteenth transistor is coupled to the eighth node, and a second electrode of the eighteenth transistor is coupled to the tenth node;

a control electrode of the nineteenth transistor is coupled to the control signal line, a first electrode of the nineteenth transistor is coupled to the tenth node, and a second electrode of the nineteenth transistor is coupled to the third node.

15. The pixel circuit of claim 8, wherein the current control circuit comprises: a second resetting sub-circuit, a second data writing sub-circuit, a second threshold compensation sub-circuit, a second output control sub-circuit, a driving transistor and a second capacitor, the second resetting sub-circuit, a control electrode of the driving transistor and the second threshold compensation sub-circuit are coupled to a fifth node, a first electrode of the driving transistor, the second data write sub-circuit and the second output control sub-circuit are coupled to a sixth node, and a second electrode of the driving transistor, the second threshold compensation sub-circuit and the second output control sub-circuit are coupled to a seventh node;

the second resetting sub-circuit is configured to write a second initialization voltage to the fifth node in response to control of a signal of a second reset signal line;

the second data writing sub-circuit is configured to write a second data voltage to the sixth node in response to control of a signal of a second gate line;

the second threshold compensation sub-circuit is configured to perform threshold compensation on the driving transistor in response to control of the signal of the second gate line;

the second output control sub-circuit is coupled to the third node, and is configured to write a first operation voltage into the sixth node, and control the third node and the seventh node to be electrically coupled, in response to control of the signal of the control signal line, the driving transistor is configured to output a corresponding driving current in response to control of a voltage at the fifth node;

a first terminal of the second capacitor is coupled to a first operation voltage terminal, and a second terminal of the second capacitor is coupled to the fifth node;

the second resetting sub-circuit comprises a ninth transistor, the second data writing sub-circuit comprises a tenth transistor, the second threshold compensation sub-circuit comprises an eleventh transistor, the second output control sub-circuit comprises a twelfth transistor and a thirteenth transistor;

a control electrode of the ninth transistor is coupled to the second reset signal line, a first electrode of the ninth transistor is coupled to a second initialization voltage terminal, and a second electrode of the ninth transistor is coupled to the fifth node;

a control electrode of the tenth transistor is coupled to the second gate line, a first electrode of the tenth transistor is coupled to a second data line, and a second electrode of the tenth transistor is coupled to the sixth node;

a control electrode of the eleventh transistor is coupled to the second gate line, a first electrode of the eleventh transistor is coupled to the fifth node, and a second electrode of the eleventh transistor is coupled to the seventh node;

a control electrode of the twelfth transistor is coupled to the control signal line, a first electrode of the twelfth transistor is coupled to the first operation voltage terminal, and a second electrode of the twelfth transistor is coupled to the sixth node;

a control electrode of the thirteenth transistor is coupled to the control signal line, a first electrode of the thirteenth transistor is coupled to the seventh node, and a second electrode of the thirteenth transistor is coupled to the third node;

the current control circuit further comprises a third capacitor, a first terminal of the third capacitor is coupled to the second gate line, and a second terminal of the third capacitor is coupled to the fifth node, and all transistors in the pixel circuit are N-type transistors; or all the transistors in the pixel circuit are P-type transistors.

16. The pixel circuit of claim 8, wherein the current control circuit comprises: a second resetting sub-circuit, a second data writing sub-circuit, a second threshold compensation sub-circuit, a second output control sub-circuit, a driving transistor, a fourth capacitor, and a fifth capacitor, wherein a control electrode of the driving transistor, the second threshold compensation sub-circuit, and the second resetting sub-circuit are coupled to an eighth node, the second resetting sub-circuit and the second data writing sub-circuit are coupled to a ninth node, and a second electrode of the driving transistor, the second threshold compensation sub-circuit, and the second output control sub-circuit are coupled to a tenth node;

the second resetting sub-circuit is configured to write a second initialization voltage and a preset constant voltage to the eighth node and the ninth node, respectively, in response to control of a signal of the second reset signal line, and write the preset constant voltage to the ninth node in response to control of the signal of the control signal line;

the second data writing sub-circuit is configured to write a second data voltage to the ninth node in response to control of a signal of the second gate line;

the second threshold compensation sub-circuit is configured to perform threshold compensation on the driving transistor in response to control of the signal of the second gate line;

the second output control sub-circuit is coupled to the third node and is configured to control the third node and the tenth node to be electrically coupled, in response to control of the signal of the control signal line;

the driving transistor is configured to output a corresponding driving current in response to control of a voltage at the eighth node;

a first terminal of the fourth capacitor is coupled to a first operation voltage terminal, and a second terminal of the fourth capacitor is coupled to the eighth node;

a first terminal of the fifth capacitor is coupled to the ninth node, and a second terminal of the fifth capacitor is coupled to the eighth node;

the second resetting sub-circuit comprises: a fourteenth transistor, a fifteenth transistor, and a sixteenth transistor, the second data writing sub-circuit comprises a seventeenth transistor, the second threshold compensation sub-circuit comprises an eighteenth transistor, the second output control sub-circuit comprises a nineteenth transistor;

a control electrode of the fourteenth transistor is coupled to the second reset signal line, a first electrode of the fourteenth transistor is coupled to a second initialization voltage terminal, and a second electrode of the fourteenth transistor is coupled to the eighth node;

a control electrode of the fifteenth transistor is coupled to the second reset signal line, a first electrode of the fifteenth transistor is coupled to a constant voltage terminal, and a second electrode of the fifteenth transistor is coupled to the ninth node;

a control electrode of the sixteenth transistor is coupled to the control signal line, a first electrode of the sixteenth transistor is coupled to the constant voltage terminal, and a second electrode of the sixteenth transistor is coupled to the ninth node;

a control electrode of the seventeenth transistor is coupled to the second gate line, a first electrode of the seventeenth transistor is coupled to the second data line, and a second electrode of the seventeenth transistor is coupled to the ninth node;

a control electrode of the eighteenth transistor is coupled to the second gate line, a first electrode of the eighteenth transistor is coupled to the eighth node, and a second electrode of the eighteenth transistor is coupled to the tenth node;

a control electrode of the nineteenth transistor is coupled to the control signal line, a first electrode of the nineteenth transistor is coupled to the tenth node, and a second electrode of the nineteenth transistor is coupled to the third node; and all transistors in the pixel circuit are N-type transistors; or all the transistors in the pixel circuit are P-type transistors.

17. A display device, comprising: a display substrate comprising a plurality of sub-pixels, at least one of the sub-pixels being provided with therein the pixel circuit according to claim 1 and an element to be driven, the pixel circuit being configured to provide a driving signal to the element to be driven.

18. The display device of claim 7, wherein the element to be driven comprises: an LED or a Micro-LED.

19. A driving method for driving the pixel circuit according to claim 1, the driving method comprising:

applying a first reset signal to the first reset signal line, a reference voltage to a reference voltage terminal, and a first initialization voltage to a first initialization voltage terminal, so that the first resetting sub-circuit writes the reference voltage and the first initialization voltage to the first node and the second node, respectively, in response to control of the reset signal;

applying a first gate scan signal to the first gate line, a first data voltage to a first data line, so that the first data writing sub-circuit writes the first data voltage to the first node in response to control of the first gate scan signal, the first threshold compensation sub-circuit performs threshold compensation on a transistor in the switch sub-circuit in response to control of the first gate scan signal; and applying a control signal to the control signal line, a ramp signal to a ramp signal line, so that the ramp writing sub-circuit writes the ramp signal to the first node in response to control of the control signal, and the switch sub-circuit adjusts a voltage at the second node according to a voltage difference between a voltage of the ramp signal applied at the first node and the first data voltage, and controls electrical coupling and decoupling between the third node and the fourth node in response to control of the voltage at the second node.

20. The driving method of claim 19, wherein the current control circuit comprises: a second resetting sub-circuit, a second data writing sub-circuit, a second threshold compensation sub-circuit, a second output control sub-circuit, a driving transistor and a second capacitor;

the driving method further comprises:

before applying the control signal to the control signal line and applying the ramp signal to the ramp signal line, applying a second reset signal to the second reset signal line, a second initialization voltage to a second initialization voltage terminal, so that the second resetting sub-circuit applies the second initialization voltage to a fifth node in response to control of the second reset signal;

applying a second gate scan signal to a second gate line, and a second data voltage to a second data line, so that the second data writing sub-circuit writes the second data voltage to a sixth node in response to control of the second gate scan signal, and the second threshold compensation sub-circuit performs threshold compensation on the driving transistor in response to control of the second gate scan signal; and in response to that the control signal is applied to the control signal line, the second output control sub-circuit writes a first operation voltage into the sixth node and control the third node and the seventh node to be electrically coupled, in response to the control signal, and the driving transistor outputs a corresponding driving current in response to control of a voltage at the fifth node.

21. The driving method of claim 19, wherein the current control circuit comprises: a second resetting sub-circuit, a second data writing sub-circuit, a second threshold compensation sub-circuit, a second output control sub-circuit, a driving transistor, a fourth capacitor and a fifth capacitor;

the driving method further comprises:

before applying the control signal to the control signal line and applying the ramp signal to the ramp signal line, applying a second reset signal to a second reset signal line, a second initialization voltage to a second initialization voltage terminal, and a constant voltage to a constant voltage terminal, so that the second resetting sub-circuit applies the second initialization voltage and the constant voltage to an eighth node and a ninth node, respectively, in response to control of the second reset signal;

applying a second gate scan signal to a second gate line, and a second data voltage to a second data line, so that the second data writing sub-circuit writes the second data voltage to the ninth node in response to control of the second gate scan signal, and the second threshold compensation sub-circuit performs threshold compensation on the driving transistor in response to control of the second gate scan signal;

in response to that the control signal is applied to the control signal line, the second resetting sub-circuit writes the constant voltage to the ninth node in response to control of the control signal, the second output control sub-circuit controls the third node and the tenth node to be electrically coupled, in response to control of the control signal, and the driving transistor outputs a corresponding driving current in response to control of a voltage at the eighth node.

* * * * *